US011045739B2

(12) United States Patent
Burleson

(10) Patent No.: US 11,045,739 B2
(45) Date of Patent: Jun. 29, 2021

(54) DOLLHOUSE ASSEMBLY

(71) Applicant: Fickle, LLC, Tulsa, OK (US)

(72) Inventor: Kendall Burleson, Tulsa, OK (US)

(73) Assignee: Fickle, LLC, Tulsa, OK (US)

( * ) Notice: Subject to any disclaimer, the term of this patent is extended or adjusted under 35 U.S.C. 154(b) by 0 days.

(21) Appl. No.: 16/565,143

(22) Filed: Sep. 9, 2019

(65) Prior Publication Data

US 2020/0078695 A1 Mar. 12, 2020

Related U.S. Application Data

(60) Provisional application No. 62/728,565, filed on Sep. 7, 2018.

(51) Int. Cl.
*A63H 3/52* (2006.01)

(52) U.S. Cl.
CPC ..... *A63H 3/52* (2013.01)

(58) Field of Classification Search
CPC ..... A63H 3/52; A63H 33/044; A63H 33/10; A63H 33/101
USPC .... 446/71, 82, 108, 109, 111, 112, 476, 478
See application file for complete search history.

(56) References Cited

U.S. PATENT DOCUMENTS 1,398,852 A * 11/1921 Gilbert ..... A63H 33/102 446/112
1,492,560 A * 5/1924 Fisher ..... A63H 33/044 446/105
2,047,748 A * 7/1936 Schmidt ..... A63H 3/52 446/478
2,062,735 A * 12/1936 Warren ..... A63H 3/52 446/115
3,577,672 A * 5/1971 Nutting ..... A63H 3/52 446/85
3,703,045 A * 11/1972 Nyman ..... A47G 1/14 40/720
3,827,177 A * 8/1974 Wengel ..... A63H 33/101 446/112
4,067,137 A * 1/1978 Korthase ..... A63H 3/52 446/478

(Continued)

FOREIGN PATENT DOCUMENTS

GB 2520986 10/2015

OTHER PUBLICATIONS

T-Sign Heavy Duty Slide-in Folding A-Frame Sidewalk Sign, Amazon.com, Jun. 1, 2018, 15 pages.

(Continued)

*Primary Examiner* — Alexander R Niconovich
(74) *Attorney, Agent, or Firm* — Dunlap Codding, P.C.

(57) ABSTRACT

A dollhouse assembly comprising a first sidewall connected to a second sidewall connected to a bottom wall connected to the first sidewall. Each of the first sidewall, the second sidewall, and the bottom wall include a top end, a bottom end, a front end, a rear end, a first panel extending between the top end the bottom end, and a second panel superimposed on the first panel and extending between the top end and the bottom end. The first panel and the second panel of each of the first sidewall, the second sidewall, and the bottom wall cooperate to define a sheet receiving space. A sheet having a design is positioned within each of the sheet receiving spaces of each of the first sidewall, the second sidewall and the bottom wall.

24 Claims, 17 Drawing Sheets

(56) References Cited

U.S. PATENT DOCUMENTS 4,195,437 A * 4/1980 Ace ..... A63H 3/52 446/104
4,212,130 A 7/1980 Walker
4,253,267 A * 3/1981 Kocolowski ..... A63H 33/044 434/72
4,270,302 A * 6/1981 Dandia ..... A63H 33/044 446/105
4,306,371 A * 12/1981 Walmer ..... A63H 3/52 446/110
4,334,868 A * 6/1982 Levinrad ..... A63F 9/0098 434/172
4,723,820 A * 2/1988 Kroneck ..... A63H 3/52 312/138.1
4,743,215 A * 5/1988 Emmons ..... E04H 15/006 135/117
4,911,670 A * 3/1990 McNicholas ..... A63H 3/52 434/429
4,919,982 A * 4/1990 Hayes ..... A63H 33/16 428/34.2
4,964,249 A * 10/1990 Payne ..... A63H 33/008 446/478
5,011,446 A * 4/1991 Feinberg ..... A63H 3/52 40/611.06
5,055,083 A * 10/1991 Walker ..... A63H 3/52 446/478
5,090,357 A * 2/1992 Pucci ..... A01K 63/006 119/256
5,120,262 A * 6/1992 Caine ..... A63H 3/52 446/476
5,345,961 A * 9/1994 Yercha ..... E04H 15/006 135/128
5,423,709 A * 6/1995 Summers ..... A63H 3/52 446/108
5,482,490 A * 1/1996 Weldon-Ming ..... A63H 3/52 446/75
5,487,690 A * 1/1996 Stoffle ..... A63H 33/10 16/225
5,749,320 A * 5/1998 Sydenstricker ..... A01K 63/006 119/253
6,065,253 A * 5/2000 Ojeda ..... A63H 3/52 446/131
6,071,174 A * 6/2000 Yoon ..... A63H 33/008 446/476
6,108,982 A * 8/2000 Davison ..... A63H 33/008 446/478
6,168,495 B1 * 1/2001 Yoon ..... A63H 33/008 446/476
6,325,086 B1 12/2001 Shinner et al.
6,360,761 B1 * 3/2002 Zheng ..... E04H 15/40 135/126
6,408,795 B1 * 6/2002 Goodger ..... A01K 31/04 119/469
6,453,923 B2 * 9/2002 Zheng ..... A63B 9/00 135/117
6,524,107 B1 * 2/2003 Brown ..... G09B 25/04 434/72
6,527,609 B1 * 3/2003 Rowland ..... A63H 3/52 446/110
6,565,413 B2 * 5/2003 Brownrigg ..... A63H 3/52 446/476
6,604,537 B2 8/2003 Zheng
6,851,439 B2 * 2/2005 Zheng ..... A63B 9/00 135/117
7,014,524 B2 * 3/2006 Farmer Brock ..... A63H 3/52 446/476
7,243,613 B2 * 7/2007 Holms ..... A01K 63/003 119/248
7,484,520 B2 * 2/2009 Zheng ..... A63B 9/00 135/117
7,749,041 B2 * 7/2010 Leleu ..... A63J 19/00 446/82
D682,951 S 5/2013 Sandhei et al.
8,827,763 B2 * 9/2014 DeBlanco ..... A63H 33/008 446/476
9,072,980 B2 * 7/2015 van Tilburg ..... A63H 3/52
9,895,623 B2 * 2/2018 Cochella ..... A63H 33/101
10,493,371 B2 * 12/2019 Cochella ..... A63H 33/101
2002/0132553 A1 * 9/2002 Jelinek ..... A63J 19/00 446/268
2003/0066553 A1 * 4/2003 Zheng ..... A63B 71/023 135/126
2005/0106996 A1 * 5/2005 Smith ..... A63H 33/008 446/476
2005/0260919 A1 * 11/2005 Porter ..... A63H 33/16 446/146
2008/0045115 A1 * 2/2008 Leleu ..... A63H 3/52 446/82
2009/0061729 A1 * 3/2009 Boerman ..... A63H 33/16 446/476
2012/0171926 A1 * 7/2012 Crnecki ..... A63H 33/008 446/478
2012/0321286 A1 * 12/2012 O'Connor ..... G03B 15/06 396/3
2017/0304738 A1 * 10/2017 Johanson ..... A63H 3/52
2019/0262731 A1 * 8/2019 Johansen ..... A63H 3/52

OTHER PUBLICATIONS

Hape Geometries Kid's Wooden Doll House Toys & Games, Amazon.com, Jun. 1, 2018, 14 pages.

* cited by examiner

DOLLHOUSE ASSEMBLY

INCORPORATION BY REFERENCE

The present patent application hereby incorporates by reference the entire provisional patent application identified by U.S. Ser. No. 62/728,565, which was filed on Sep. 7, 2018.

BACKGROUND

Dollhouses have enchanted both children and adults for countless generations. Dollhouses have been constructed in various shapes, colors, and sizes. However, the appearance of a dollhouse is usually dictated by the manufacturer's design. Some dollhouses are sold unassembled and unpainted to allow children to dictate the shape and color. However, these dollhouses are designed to be customized only once. Furthermore, once assembled, dollhouses are typically cumbersome to disassemble and transport.

Some attempts have been made to solve the deficiencies of certain dollhouses. Examples include dollhouses that are customizable through different stacking configurations. However, such devices are not easily assembled and disassembled and are often limited as to the shapes, sizes, and internal and external designs of dollhouses that may be constructed. Other dollhouses have been provided that hold a drawing paper along the house's inside surfaces for displaying drawings that could be made a conventional manner as in a coloring book. However, such dollhouses lack features for customizing the configuration and shape of the house.

Thus, there is a need for a modular dollhouse that can be constructed of pieces and dimensions that allow for flexibility in design and use, which also incorporates tools and methods for easily changing internal and external ornamental designs of the dollhouse. There is also a need for a dollhouse that can be quickly dissembled, flat-packed and easily stored until a child is ready to play with it again.

BRIEF DESCRIPTION OF THE DRAWINGS

Like reference numerals in the figures represent and refer to the same or similar element or function. Embodiments of the present disclosure may be better understood when consideration is given to the following detailed description thereof. Such description refers to the annexed pictorial illustrations, schematics, graphs, drawings, and appendices. In the drawings.

DETAILED DESCRIPTION OF EXEMPLARY EMBODIMENTS

Figure 1:
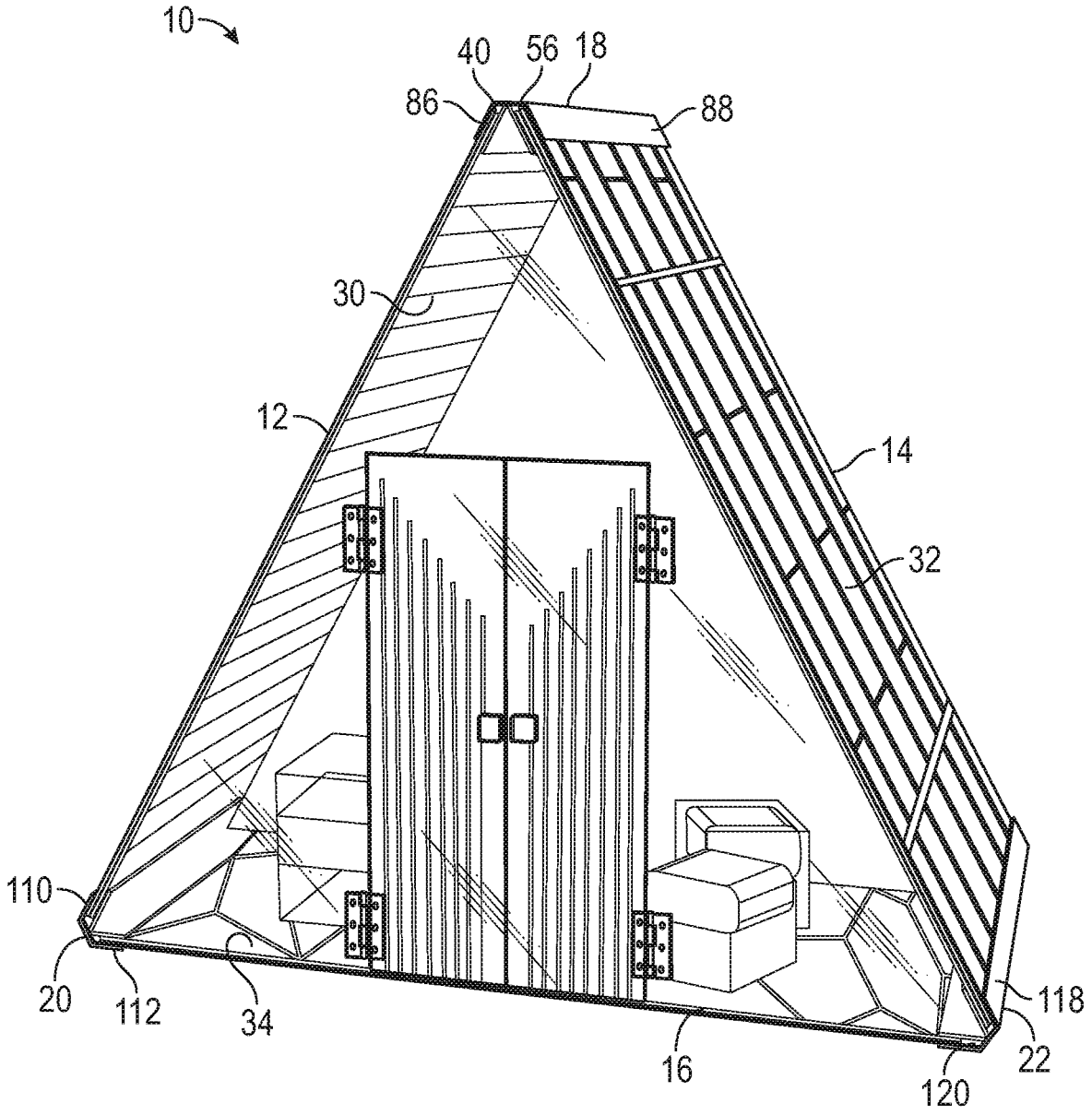
FIG. 1 is a front perspective view of a dollhouse assembly constructed in accordance to the inventive concepts disclosed herein.

The inventive concepts disclosed are generally directed to a dollhouse assembly that includes a first sidewall connected to a second sidewall and a bottom wall and a second sidewall connected to the first sidewall and the bottom wall. The first sidewall has a top end, a bottom end, a front end, and a rear end. The first sidewall includes a first panel extending between the top end and the bottom end, and a second panel superimposed on the first panel and extending between the top end and the bottom end. The first panel and the second panel of the first sidewall cooperate to define a sheet receiving space. The second sidewall has a top end, a bottom end, a front end, and a rear end. The second sidewall includes a first panel extending between the top end the bottom end, and a second panel superimposed on the first panel and extending between the top end and the bottom end. The first panel and the second panel of the second sidewall cooperate to define a sheet receiving space. The bottom wall has a left end, a right end, a front end, and a rear end. The bottom wall includes a first panel extending between the left end and the right end, and a second panel superimposed on the first panel and extending between the left end and the right end. The first panel and the second panel of the bottom wall cooperate to define a sheet receiving space.

The inventive concepts disclosed are also generally directed to a method of forming a dollhouse assembly. The method includes the steps of obtaining a first sidewall having a top end, a bottom end, a front end, and a rear end, the first sidewall including a first panel extending between the top end and the bottom end, and a second panel superimposed on the first panel and extending between the top end and the bottom end, the first panel and the second panel cooperating to a define a sheet receiving space; obtaining a second sidewall having a top end, a bottom end, a front end, and a rear end, the second sidewall including a first panel extending between the top end the bottom end, and a second panel superimposed on the first panel and extending between the top end and the bottom end, the first panel and the second panel cooperating to define a sheet receiving space; obtaining a bottom wall having a left end, a right end, a front end, and a rear end, the bottom wall including a first panel extending between the left end and the right end, and a second panel superimposed on the first panel and extending between the left end and the right end, the first panel and the second panel cooperating to define a sheet receiving space; connecting the top end of the first sidewall to the top end of the second sidewall; connecting the bottom end of the second sidewall to the right end of the bottom sidewall; and connecting the bottom end of the first sidewall to the left end of the bottom wall.

The inventive concepts disclosed are further directed to a kit for forming for a dollhouse assembly. The kit includes a first sidewall, a second sidewall, and a bottom wall. The first sidewall has a top end, a bottom end, a front end, and a rear end. The first sidewall includes a first panel extending between the top end and the bottom end, and a second panel superimposable on the first panel and extending between the top end and the bottom end. The first panel and the second panel cooperate to a define a sheet receiving space. The second sidewall has a top end, a bottom end, a front end, and a rear end. The second sidewall includes a first panel extending between the top end the bottom end, and a second panel superimposable on the first panel and extending between the top end and the bottom end. The first panel and the second panel cooperate to define a sheet receiving space. The top end of the second sidewall is connectable to the top end of the first sidewall. The bottom wall has a left end, a right end, a front end, and a rear end. The bottom wall includes a first panel extending between the left end and the right end, and a second panel superimposable on the first panel and extending between the left end and the right end. The first panel and the second panel cooperate to define a sheet receiving space. The right end of the bottom wall is connectable to the bottom end of the second sidewall. The left end of the bottom wall is connectable to the bottom end of the first sidewall.

Before explaining at least one embodiment of the present disclosure in detail, it is to be understood that embodiments of the present disclosure are not limited in their application to the details of construction and the arrangement of the components or steps or methodologies set forth in the following description or illustrated in the drawings. The inventive concepts in the present disclosure are capable of other embodiments or of being practiced or carried out in various ways. Also, it is to be understood that the phraseology and terminology employed herein is for the purpose of description and should not be regarded as limiting.

In this detailed description of embodiments of the inventive concepts, numerous specific details are set forth in order to provide a more thorough understanding of the inventive concepts. However, it will be apparent to one of ordinary skill in the art that the inventive concepts disclosed and claimed herein may be practiced without these specific details. In other instances, well-known features have not been described in detail to avoid unnecessarily complicating the instant disclosure.

As used herein, language such as "including," "comprising," "having," "containing," or "involving," and variations thereof, is intended to be broad and encompass the subject matter listed thereafter, equivalents, and additional subject matter not recited or inherently present therein.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

Throughout this disclosure and the claims, the terms "about," "approximately," and "substantially" are intended to signify that the item being qualified is not limited to the exact value specified, but includes slight variations or deviations therefrom, caused by measuring error, manufacturing tolerances, stress exerted on various parts, wear and tear, or combinations thereof, for example.

The use of the term "at least one" will be understood to include one and any quantity more than one, including but not limited to each of, 2, 3, 4, 5, 10, 15, 20, 30, 40, 50, 100, and all integers therebetween. The term "at least one" may extend up to 100 or 1000 or more, depending on the term to which it is attached; in addition, the quantities of 100/1000 are not to be considered limiting, as higher limits may also produce satisfactory results. Singular terms shall include pluralities and plural terms shall include the singular unless indicated otherwise.

The term "or combinations thereof" as used herein refers to all permutations and/or combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AAB, BBC, AAABCCCC, CBBAAA, CABABB, and so forth. The skilled artisan will understand that typically there is no limit on the number of items or terms in any combination, unless otherwise apparent from the context.

Finally, as used herein any reference to "one embodiment" or "an embodiment" means that a particular element, feature, structure, or characteristic described in the embodiment is included in at least one embodiment. The appearances of the phrase "in one embodiment" in various places in the specification are not necessarily referring to the same embodiment, although the inventive concepts disclosed herein are intended to encompass all combinations and permutations including one or more features of the embodiments described.

Referring now to FIGS. 1-7, shown therein is a dollhouse assembly 10 according to the present disclosure. The dollhouse assembly 10 includes a first sidewall 12 connected to a second sidewall 14 by a first connecting member 18, and a bottom sidewall 16 connected to the first sidewall 12 by a second connecting member 20 and connected to the second sidewall 14 by a third connecting member 22. In the embodiment shown in FIGS. 1-3, the first sidewall 12, the second sidewall 14, and the bottom wall 16 cooperate to form a triangular shaped house for housing dolls, dollhouse furniture, and other dollhouse furniture accessories including, but not limited to light fixtures and appliances. The dollhouse 10 may be dissembled by disconnecting the first sidewall 12 from the second sidewall 14 and the bottom wall 16 and the second sidewall 14 from the bottom wall 16. Each of the first, second, and bottom walls 12/14/16 may be flat-packed for storage.

Each of the first and second sidewalls and bottom wall 12/14/16 include a sheet receiving space, such as sheet receiving spaces 24, 26, and 28. The walls 12/14/16 may be formed of a transparent material for displaying a sheet with a design, such as a first sheet 30, a second sheet 32, and a third sheet 34. The sheets 30, 32, and 34 may include designs on each of the respective sides of the sheets, may be interchangeable, and may be replaced with other sheets having different designs (not shown). As such, a user is able to easily change the design of the dollhouse 10 by inserting and removing various sheets into the sheet receiving spaces 24/26/28 of the first, second, and bottom walls 12/14/16, respectively. The sheets 30, 32, and 34 may include various designs, for example, but not be a way of limitation, shingled roof designs, textured ceiling designs, decorative and/or wall designs and decorative and/or functional floor designs. FIGS. 14-22 show various designs, such as design 502, 504, 506, 508, 510, 512, 514, 516, and 518, which may be inserted into the sheet receiving spaces. Designs may be featured on one or both sides of the sheets 30, 32, and 34.

Figure 2:
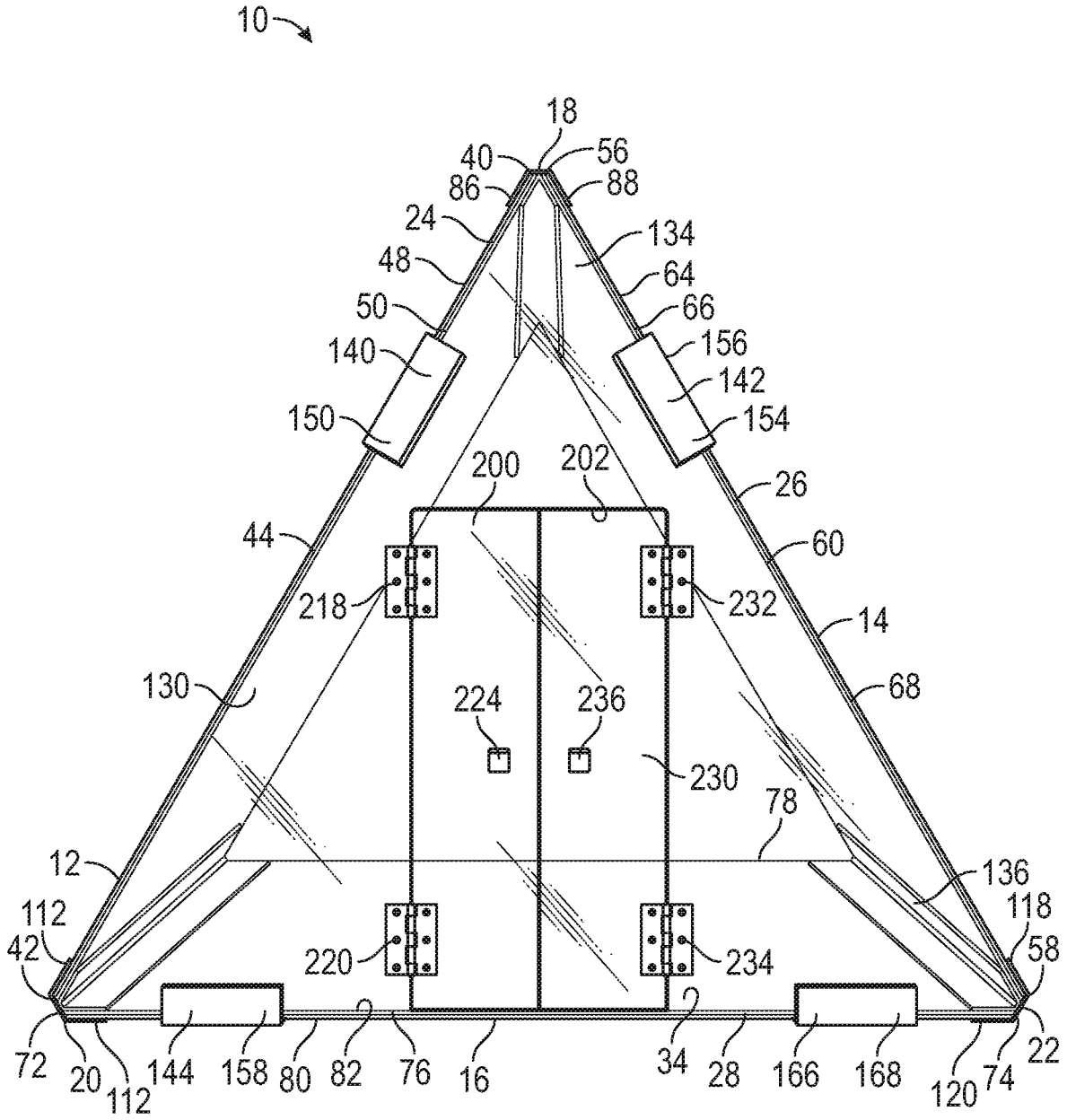
FIG. 2 is a front elevation view of the dollhouse assembly.
Figure 3:
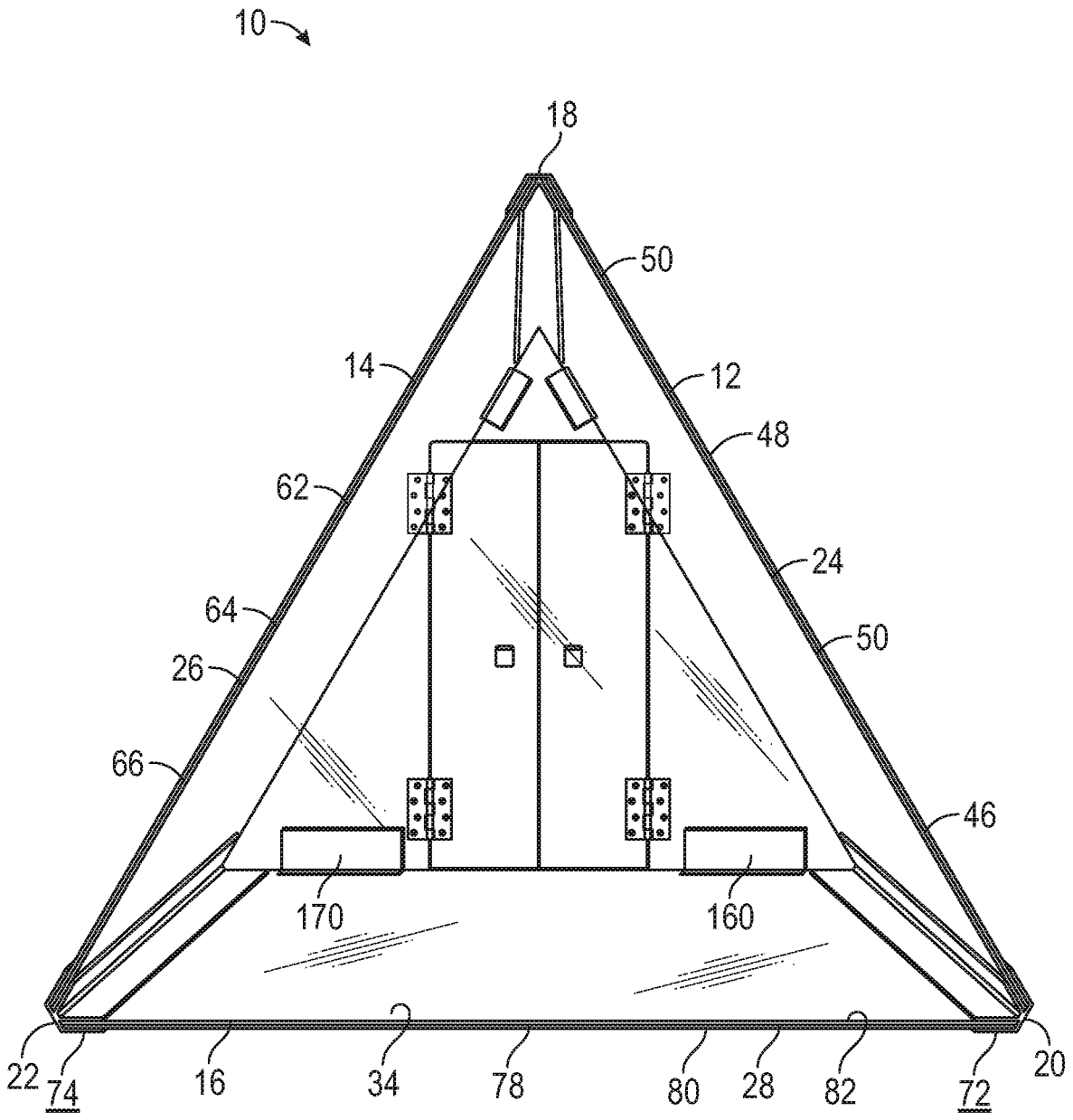
FIG. 3 is a rear elevation view of the dollhouse assembly.
Figure 4:
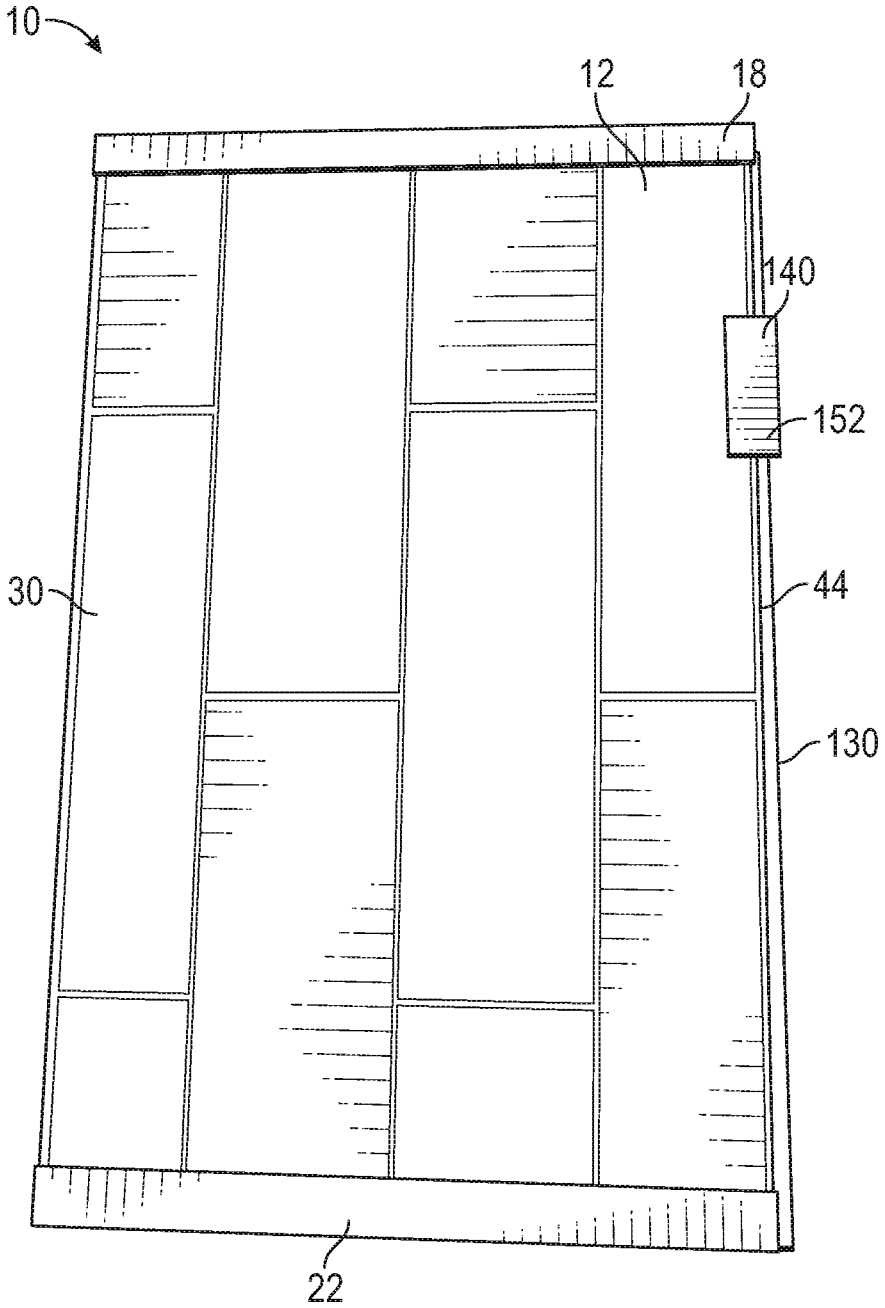
FIG. 4 is a side elevation view of the dollhouse assembly.
Figure 5:
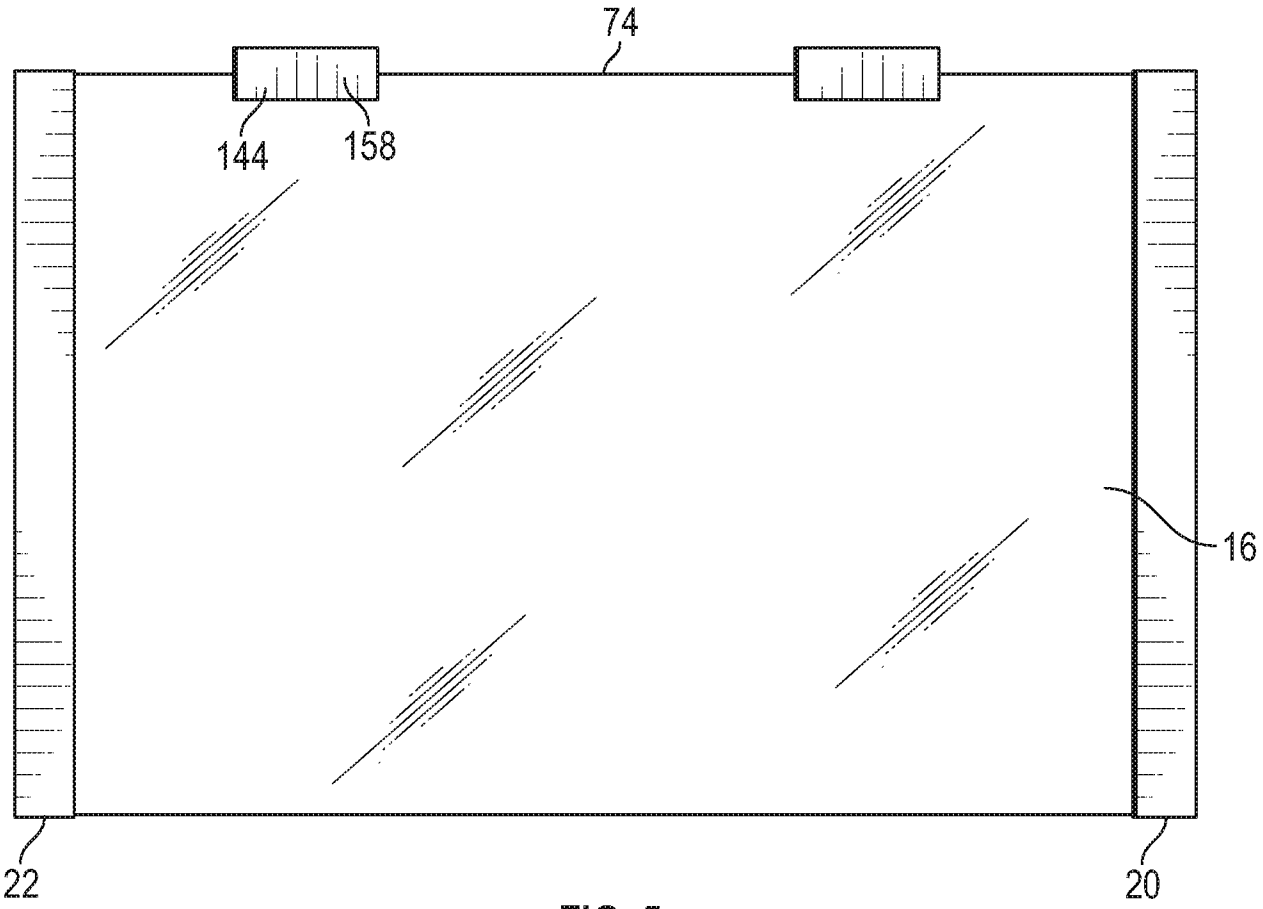
FIG. 5 is a bottom view of the dollhouse assembly.
Figure 6:
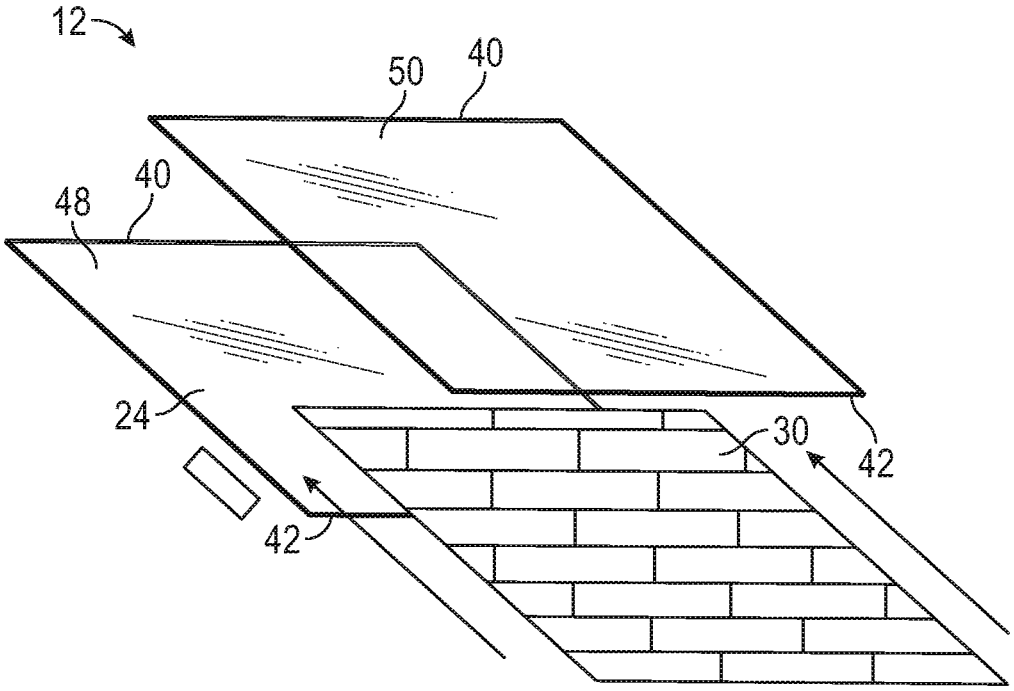
FIG. 6 an exploded view of a sidewall of the dollhouse assembly.

As best shown in FIG. 2, the first sidewall 12 has a top end 40, a bottom end 42, a front end 44, and a rear end 46 (shown in FIG. 3). As best shown in FIG. 6, the first sidewall 12 also includes a first panel 48 extending between the top end 40 and the bottom end 42, and a second panel 50 superimposed on the first panel 48 and extending between the top end 40 and the bottom end 42. The first panel 48 and the second panel 50 cooperate to define the sheet receiving space 24. The sheet 30 is positioned in the sheet receiving space 24 of the first sidewall 12.

As shown in FIG. 2, the second sidewall 14 has a top end 56, a bottom end 58, a front end 60, and a rear end 62 (shown in FIG. 3). The second sidewall 14 also includes a first panel 64 extending between the top end 56 and the bottom end 58, and a second panel 66 superimposed on the first panel 64 and extending between the top end 56 and the bottom end 58. The first panel 64 and the second panel 66 cooperate to define the sheet receiving space 26. The sheet 32 (best shown in FIG. 1) is positioned in the sheet receiving space 26 of the second sidewall 14.

The bottom wall 16 has a left end 72, a right end 74, a front end 76, and a rear end 78. As best shown in FIG. 3, the bottom wall 16 also includes a first panel 80 extending between the left end 72 and the right end 74 and a second panel 82 superimposed on the first panel 80 and extending between the left end 72 and the right end 74. The first panel 80 and the second panel 82 cooperate to define the sheet receiving space 28. The sheet 34 may be positioned in the sheet receiving space 28 of the bottom wall 16.

The first sidewall 12, the second sidewall 14, and the bottom wall 16 may be formed of the substantially the same size and materials. The first panel 48 and the second panel 50 of the first sidewall 12 may have, but are not limited to having, a length between about 15.0 and about 30.0 inches. For example, but not by way of limitation, in one embodiment the first panel 48 and the second panel 50 are about 22.75 inches long. When the second panel 50 is superimposed on the first panel 48, the first sidewall 12 may have a variety of thickness and may be, but is not limited to being, between about 0.15 and about 2.0 inches think. For example, but not by way of limitation, in one embodiment, the first sidewall 12 is about 0.25 inches thick. The first panel 48 and the second panel 50 may be formed from a variety of materials including, but not limited to acrylic. For purposes of brevity, it should be appreciated that each of the first and second panels of each of the walls 12/14/16 may be formed substantially the same.

Figure 7:
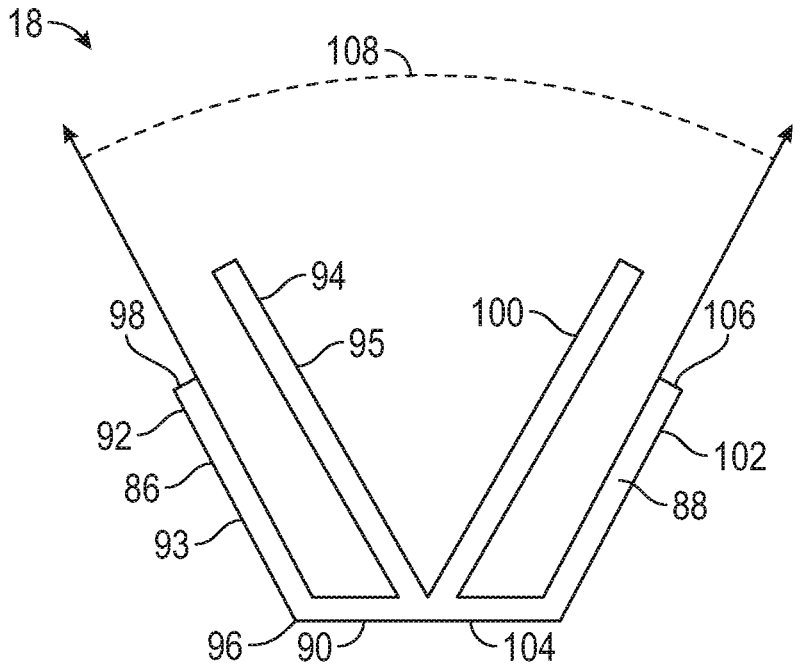
FIG. 7 is a front elevation view of a connecting member of the dollhouse assembly.

As shown in FIGS. 1-2, the first connecting member 18 is connected to the top end 40 of the first sidewall 12 and the top end 56 of the second sidewall 14 to connect the first sidewall 12 to the second sidewall 14. The first connecting member 18 may include a first clip portion 86 connected to the top end 40 of the first sidewall 12 to connect the first panel 48 to the second panel 50 of the first sidewall 12 and a second clip portion 88 connected to the top end 56 of the second sidewall 14 to connect the first panel 64 to the second panel 66 of the second sidewall 14. As shown in FIG. 7, the first connecting member 18 may also include a base portion 90. The first clip portion 86 of the first connecting member 18 may include a first pair of arms 92 and 94 extending from the base portion 90 to grasp the first panel 48 and the second panel 50 of the first sidewall 12. The pair of arms 92 and 94 includes a proximal end 96 and a distal end 98. The pair of arms 92 and 94 taper towards the distal end 98. This tapering may aid in the grasping of the first panel 48 and the second panel 50 of the first sidewall 12. The first clip portion 86 of the first connecting member may also include a second pair of arms 100 and 102 extending from the base portion 90 to grasp the first panel 64 and the second panel 66 of the second sidewall 14. The pair of arms 100 and 102 includes a proximal end 104 and a distal end 106. The pair of arms 100 and 102 taper towards the distal end 106. This tapering may aid in the grasping of the first panel 64 and the second panel 66 of the second sidewall 14. The first clip portion 86 and the second clip portion 88 may cooperate to form an angle 108. The angle 108 may be, but is not limited to being, about 60 degrees.

The second connecting member 20 is connected to the bottom end 42 of the first sidewall 12 and to the left end 72 of the bottom wall 16 to connect to the first sidewall 12 to the bottom wall 16. The second connecting member 20 may include a first clip portion 110 connected to the bottom end 42 of the first sidewall 12 to connect the first panel 48 to the second panel 50 of the first sidewall 12 and a second clip portion 112 connected to the left end 72 of the bottom wall 16 to connect the first panel 80 to the second panel 82 of the bottom wall 16.

The third connecting member 22 is connected to the bottom end 58 of the second sidewall 14 and the right end 74 of the bottom wall 16 to connect the second sidewall 14 to the bottom wall 16. The third connecting member 22 may include first clip portion 118 connected to the bottom end 58 of the second sidewall 14 to connect the first panel 64 to the second panel 66 of the second sidewall 14 and a second clip portion 120 connected to the right end 74 the bottom wall 16 to connect the first panel 80 to the second panel 82 of the bottom wall 16.

The second connecting member 20 and the third connecting member 22 may be constructed substantially similar to the first connecting member 18. For purposes of brevity, the connecting member 18 is used as an illustrative example for the second and third connecting members 20 and 22 in FIG. 7. Each connecting member 18, 20, and 22 may be formed of a variety of materials including, but not limited to, plastic. The base of each connecting member 18, 20, and 22 may be a variety of widths and may have, but is not limited to having a width between about 0.5 and about 3.0 inches. For example, but not by way of limitation, in one embodiment, the base of each connecting member 18, 20, and 22 is about 0.876 inches wide. The pair of arms of that comprise each of the first clip member and the second clip member of each of the connecting members 18/20/22 may be formed of a variety of lengths and may have, but are not limited to having a length between about 0.5 and about 3.0 inches. For example, but not by way of limitation, in one embodiment, one of the arms, such as arm 93 is about 0.0875 inches long and another one of the arms, such as arm 95, is about 1.250 inches long. The arm 93 may be spaced a variety of distances from the arm 95 and may be spaced, but is not limited to being spaced, between about 0.15 and about 1.0 inches from the arm 95. For example, but not by way of limitation, in one embodiment, the arm 93 is spaced about 0.25 inches from the arm 95.

As shown in FIG. 2, the dollhouse assembly 10 may further include a front wall 130. The front wall 130 is connected to the first sidewall 12, the second sidewall 14, and the bottom wall 16. The front wall 130 includes an upper portion 134 and a lower portion 136. The front wall 130 is connected to the first sidewall 12, the second sidewall 14, and the bottom wall 16 by a fourth connecting member 140, a fifth connecting member 142, and a sixth connecting member 144. The front wall 130 may be formed of any suitable material such as, but not limited to acrylic. For example, but not by way of limitation, the front wall 130 may be formed of a single transparent acrylic panel allowing a user to see inside the dollhouse assembly 10. The size and shape of the front wall 130 may substantially correspond to the size and shape of an opening formed by the first and second sidewalls 12 and 14 and the bottom wall 16. For example, but not by way of limitation, the front wall 130 may be triangularly shaped.

The fourth connecting member 140 includes a first clip portion 150 connected to the front wall 130 and a second clip portion 152 connected (best shown in FIG. 4) to the front end 44 of the first sidewall 12. The fifth connecting member 142 includes a first clip portion 154 connected to the front wall 130 and a second clip 156 connected to the front end 60 of the second sidewall 14. The sixth connecting member 144 includes a first clip 158 connected to the front wall 130 and a second clip portion 160 (best shown in FIG. 3) connected to the front end 76 of the bottom wall 16.

The dollhouse assembly 10 may further include a seventh connecting member 166 for connecting the front wall 130 to the bottom wall 16. The seventh connecting member 166 includes a first clip portion 168 connected to the front wall 130 and a second clip portion 170 (best shown in FIG. 3) connected to the front end 76 of the bottom wall 16. When the dollhouse assembly 10 includes the seventh connecting member 166, the sixth connecting member 144 is positioned near the first sidewall 12 and the seventh connecting member 166 is positioned near the second sidewall 14.

Figure 8:
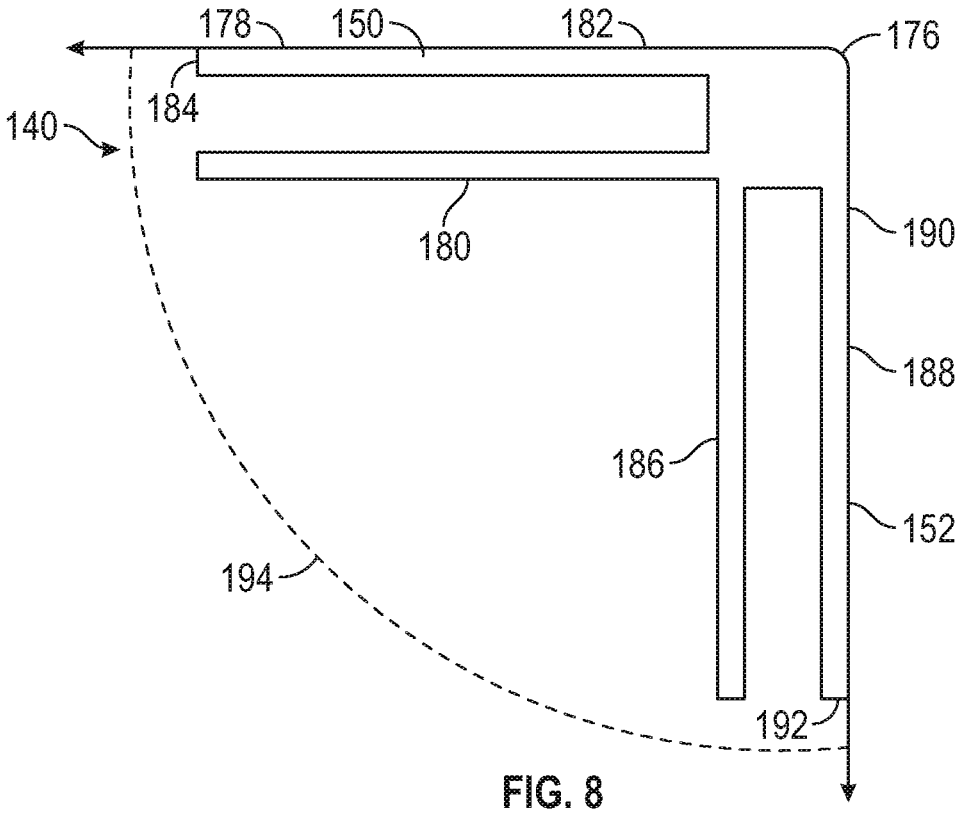
FIG. 8 is a front elevation view of another connecting member of the dollhouse assembly.

As shown in FIG. 8, the fourth connecting member 140 may also include a base portion 176. The first clip portion 150 of the fourth connecting member 140 may include a first pair of arms 178 and 180 extending from the base portion 176 to grasp the front wall 130. The pair of arms 178 and 180 includes a proximal end 182 and a distal end 184. The pair of arms 178 and 180 may taper towards the distal end 184. This tapering may aid in the grasping of the front wall 130. The second clip portion 152 of the fourth connecting member 140 may include a second pair of arms 186 and 188 extending from the base portion 176 to grasp the first panel 48 and the second panel 50 of the first sidewall 12 at the front end 44 of the first sidewall 12. The pair second of arms 186 and 188 may include a proximal end 190 and a distal end 192. The pair of arms 186 and 188 may taper towards the distal end 192. This tapering may aid in the grasping of the first panel 48 and the second panel 50 of the first sidewall 12. The first clip portion 150 and the second clip portion 152 may cooperate to form an angle 194. The angle 194 may be 90 degrees.

The fourth, fifth, sixth, and seventh connecting members 140, 142, 144, and 166 may be constructed substantially the same. Each connecting member 140/142/144/166 may be formed of a variety of materials including, but not limited to, plastic. The base (such as base 176) of each connecting member 140/142/44/166 may be a variety of widths and may have, but is not limited to having, a width between about 0.5 and about 3.0 inches. For example, but not by way of limitation, in one embodiment, the base of each connecting member is about 0.876 inches wide. The pair of arms 178/180 and 186/188 that comprise each of the first clip members and the second clip members of each of the connecting members 140/142/144/166 may be formed of a variety of lengths and may have, but are not limited to having, a length between about 0.5 and about 3.0 inches. For example, but not by way of limitation, in one embodiment one of the arms, such as the arm 178, is about 0.0875 inches long and another one of the arms, such as the arm 180, is about 1.250 inches long. The arm 178 may be spaced a variety of distances from the arm 180 and may be spaced, but is not limited to being spaced, about 0.15 to about 1.0 inches from the arm 180. For example, but not by way of limitation, in one embodiment, the arm 178 is spaced 0.25 inches from arm 180.

Figure 9:
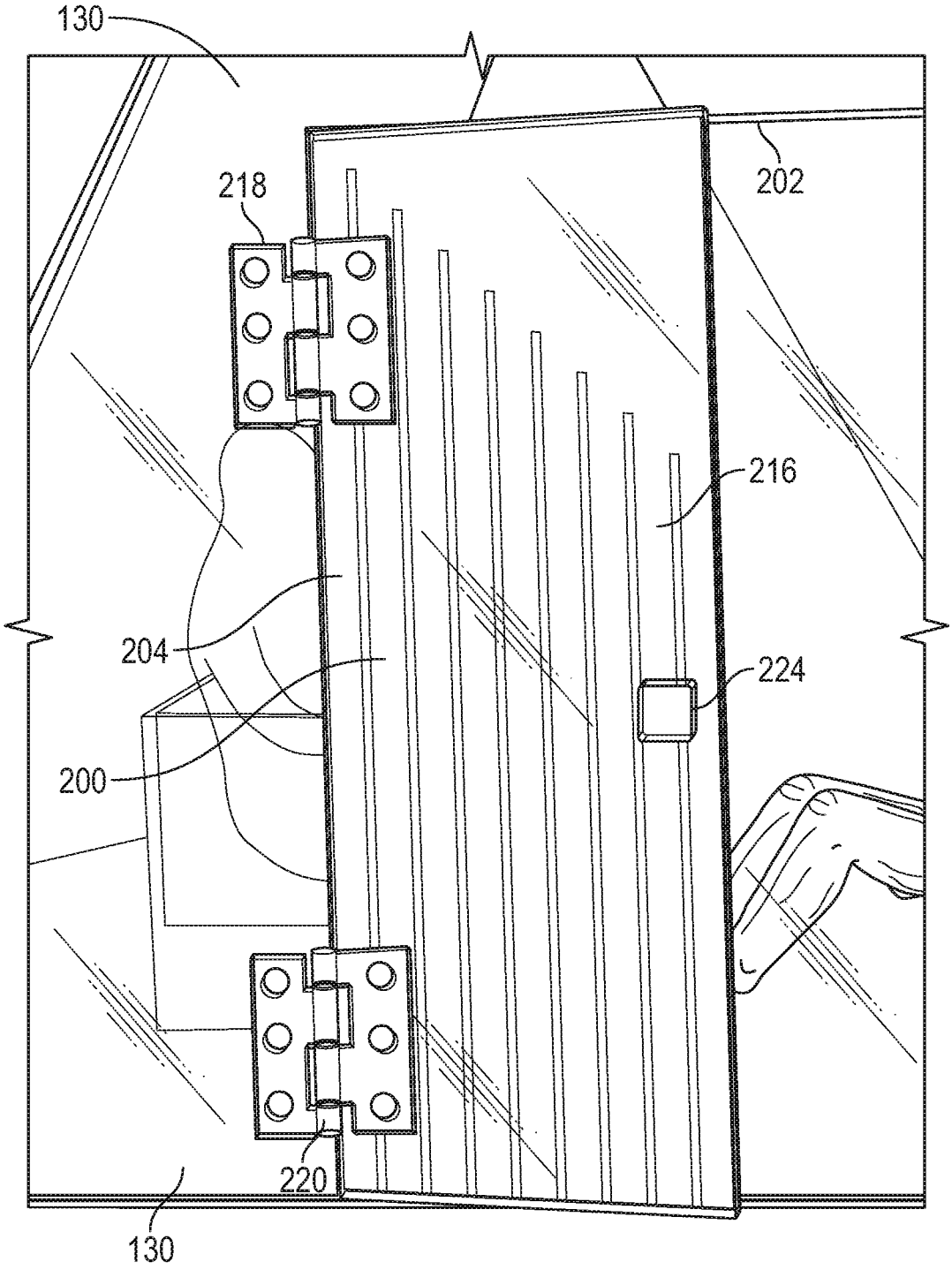
FIG. 9 is a front elevation view of a front wall of the dollhouse assembly showing a door in a closed position.
Figure 10:
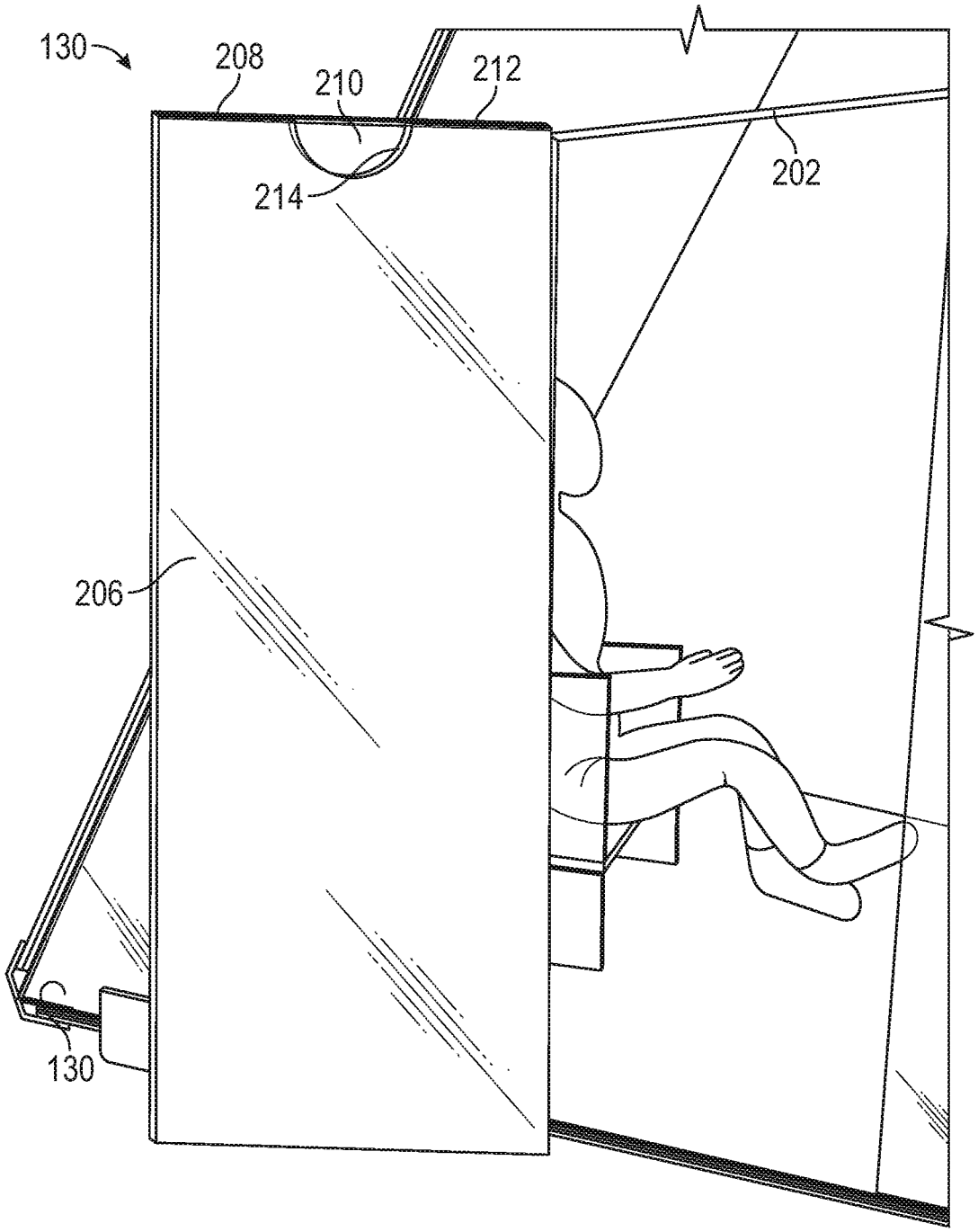
FIG. 10 is a front perspective view of the front wall of the dollhouse assembly showing the door in an open position.

As shown in FIGS. 2 and 9-10, the dollhouse assembly 10 may include a door 200. The front wall 130 may form a door opening 202. The door 200 is hingedly connected to the front wall 130 to extend across the door opening 202. As best shown in FIGS. 9-10, the door 200 includes a first panel 204 connected to a second panel 206 to form a sheet receiving space 208. A door sheet 210 may be positioned in the sheet receiving space 208 of the door 200. The second panel 206 of the door 200 may include a top end 212 and a notch 214 positioned at the top end 212 for inserting and removing the door sheet 210. The door 200 may be formed of a transparent material, and the sheet 210 may include a design (such as design 216) for displaying through the door 200. The door sheet 210 may include a design on each side of the sheet 210. The door sheet 210 may be formed of any suitable material including, but not limited to paper, and may be formed of any suitable size and shape which substantially corresponds to the size and shape of the door 200 and the door sheet receiving space 208. The door 200 may be connected to the front wall 130 by a pair of hinges 218 and 220. The door may also include a handle 224 for opening and closing the door. The pair of hinges 218/220 and the handle 224 may be formed of any known suitable material including but not limited to the same material as the door 200, which may be, for example, acrylic.

As best shown in FIG. 2, the dollhouse assembly 10 may also include a second door 230 hingedly connected to the front wall 130 to extend across the door opening 202. The second door 230 may also include a first panel connected to a second panel to form a door sheet receiving space. A second door sheet may be positioned in the door sheet receiving space of the second door. The second panel of the second door may include a top end and a notch positioned at the top end for inserting and removing the second door sheet. The second door sheet may include a design on one or more sides of the sheet. The second door 230 may be connected to the front wall 130 by a pair of hinges 232 and 234. The second door 230 may also include a handle 236 for opening and closing the second door 230. The pair of hinges 232/234 and the handle 236 may be formed of any known suitable material including but not limited to the same material as the door 200, which may be, for example, acrylic. The second door 230 may be formed of the substantially the same size and material as the first door 200.

Figure 11:
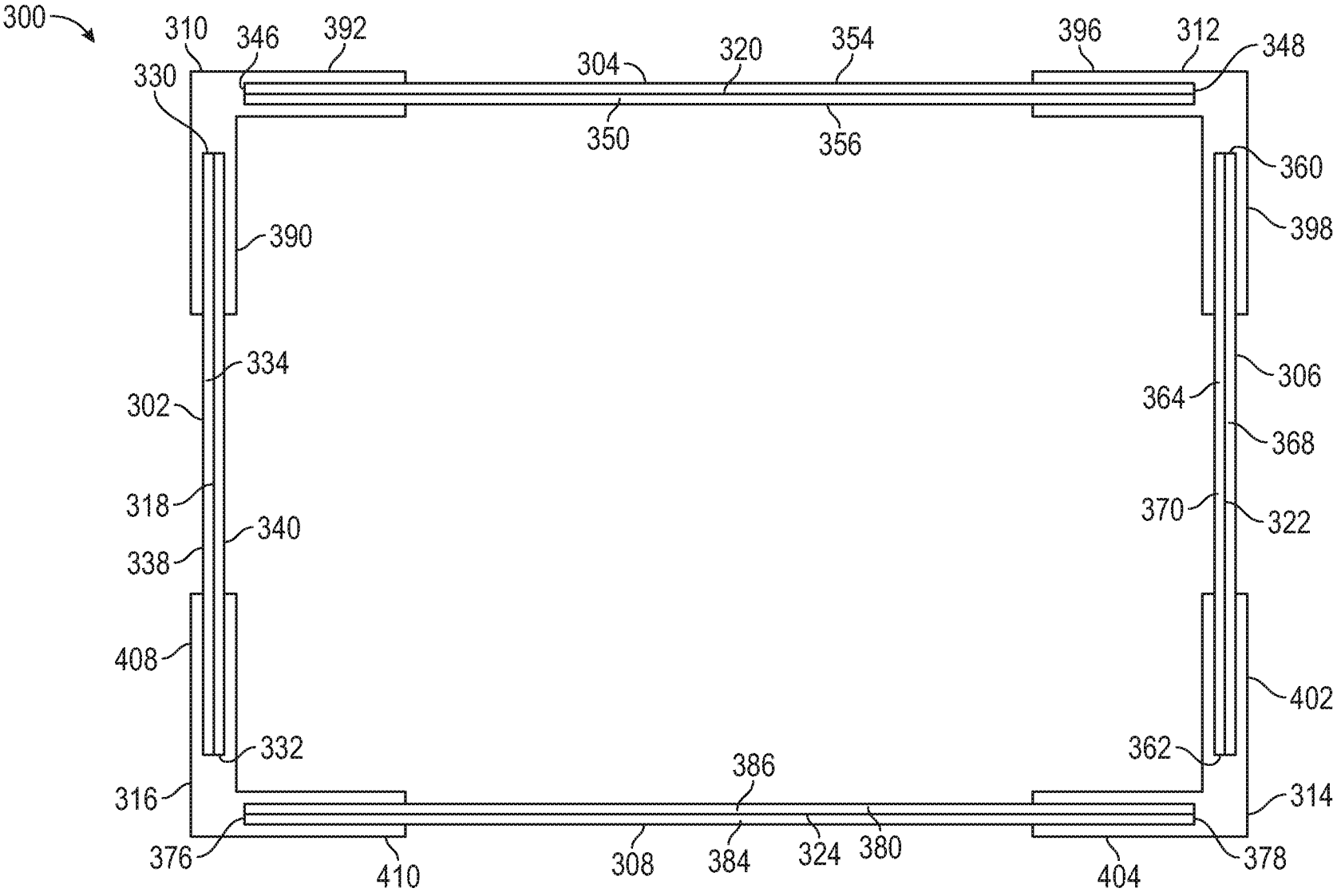
FIG. 11 is a front elevation view of another embodiment of a dollhouse assembly shown with a front wall removed.
Figure 12:
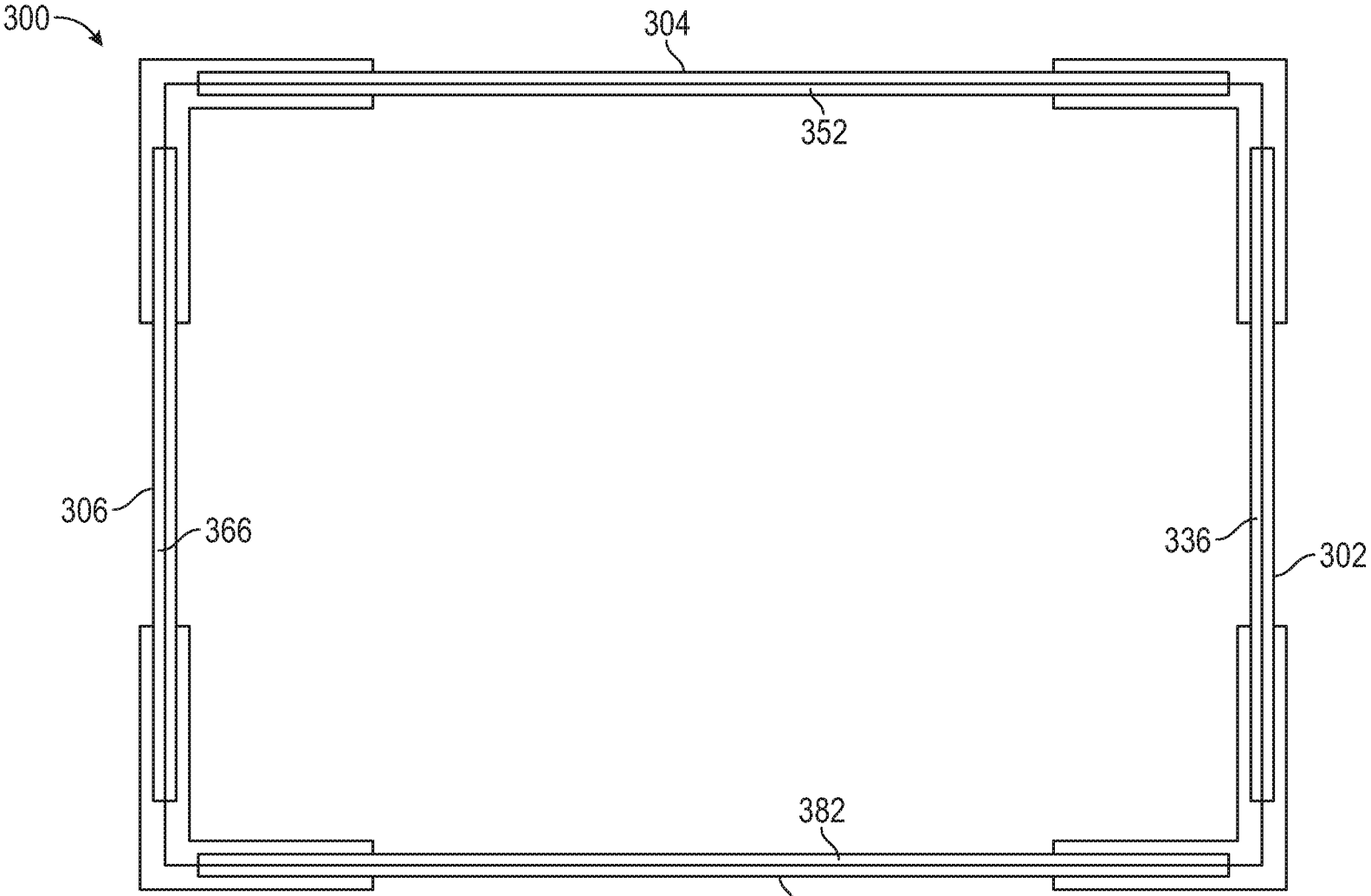
FIG. 12 is a rear elevation view of the dollhouse assembly of FIG. 11.
Figure 13:
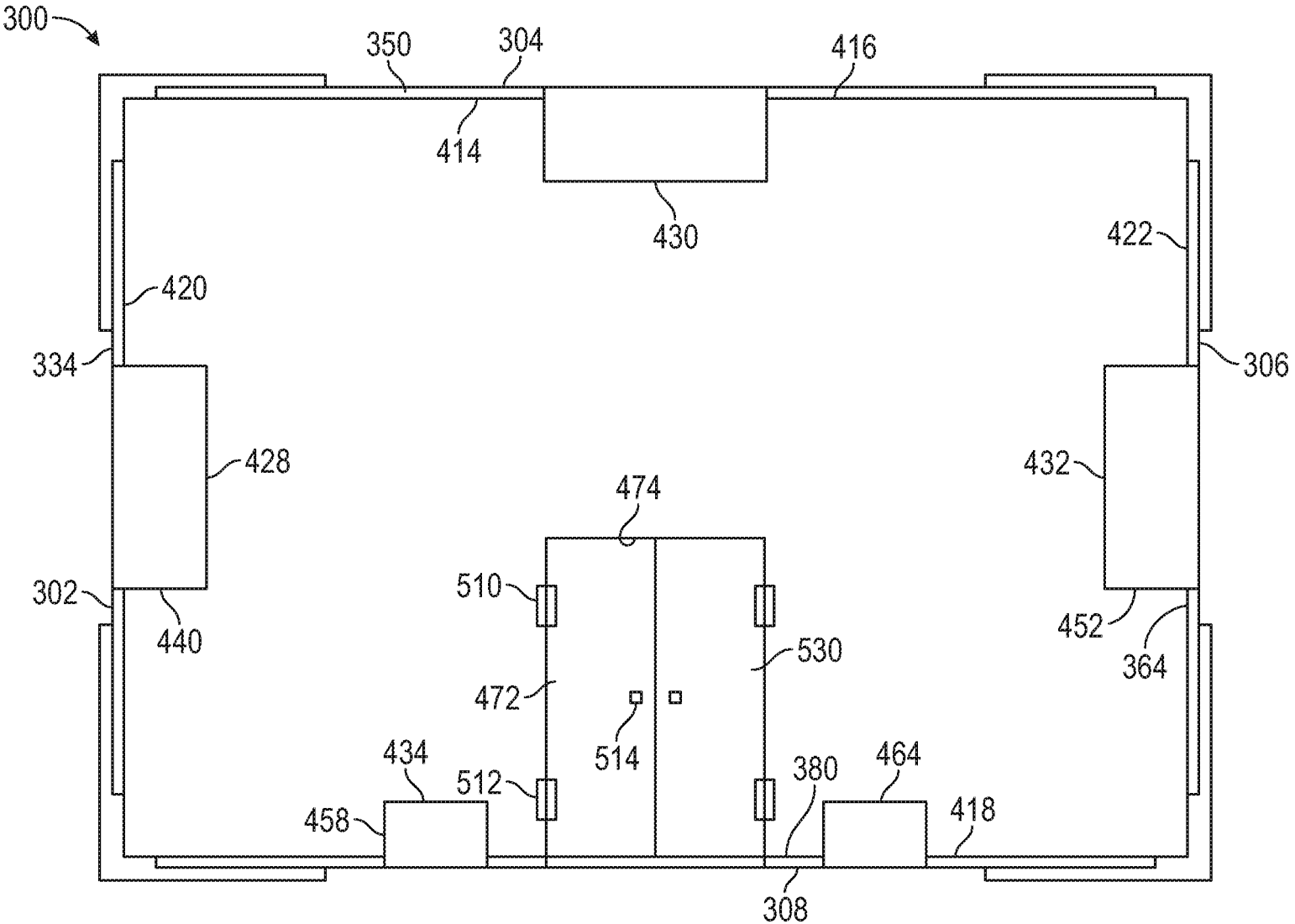
FIG. 13 is a front elevation view of the dollhouse assembly of FIG. 11 shown with the front wall attached.

Now referring to FIGS. 11-13, shown therein is another embodiment of a dollhouse assembly, such as dollhouse 300. The dollhouse assembly 300 includes a first sidewall 302 connected to a top wall 304 by a first connecting member 310, a second sidewall 306 connected to the top wall 304 by a second connecting member 312, and a bottom wall 308 connected to the second sidewall 306 by a third connecting member 314 and connected to the first sidewall 302 by a fourth connecting member 316. In the embodiment shown in FIGS. 11-12, the first sidewall 302, the top wall 304, the second sidewall 306, and the bottom wall 308 cooperate to form a square shaped house for housing dolls, dollhouse furniture, and other dollhouse furniture accessories including, but not limited to light fixtures and appliances. Each of the first sidewall, the top wall, second sidewall, and bottom wall 302/304/306/308 include a sheet receiving space, such as sheet receiving spaces 318, 320, 322, and 324, and may be formed of transparent material for displaying a sheet with a design, such as a first sheet, a second sheet, and a third sheet, and a fourth sheet (now shown). The first, second, third, and fourth sheets may include designs on each side of the sheet, may be interchangeable and may be replaced with other sheets having designs—substantially similar to dollhouse assembly 10. As such, a user is able to easily change the ornamental design of the dollhouse by inserting and removing various sheets into the first, second, and bottom sidewalls to display, for example, a variety of roof, ceiling, wall, and floor designs. The first, second, third, and fourth sheets may include, but are not limited to including, designs 502, 504, 506, 508, 510, 512, 514, 516, and 518. Designs may be included on one or both sides of the first, second, third, and fourth sheets.

The first sidewall 302 has a top end 330, a bottom end 332, a front end 334, and a rear end 336 (shown in FIG. 12). The first sidewall 302 also includes a first panel 338 extending between the top end 330 and the bottom end 332, and a second panel 340 superimposed on the first panel 338 and extending between the top end 330 and the bottom end 332. The first panel 338 and the second panel 340 cooperate to define the sheet receiving space 318. The first sheet is positioned in the sheet receiving space 318 of the first sidewall 330.

As shown in FIG. 11, the top wall 304 has a left end 346, a right end 348, a front end 350, and a rear end 352 (shown in FIG. 12). The top wall 304 also includes a first panel 354 extending between the left end 346 and the right end 348, and a second panel 356 superimposed on the first panel 354 and extending between the left end 346 and the right end 348. The first panel 354 and the second panel 356 cooperate to define the sheet receiving space 320. The second sheet is positioned in the sheeting receiving space 320 of the top wall 304.

The second sidewall 306 has a top end 360, a bottom end 362, a front end 364, and a rear end 366 (shown in FIG. 12). The second sidewall 306 also includes a first panel 368 extending between the top end 360 and the bottom end 362, and a second panel 370 superimposed on the first panel 368 and extending between the top end 360 and the bottom end 362. The first panel 368 and the second panel 370 cooperate to define the sheet receiving space 322. The third sheet is positioned in the sheeting receiving space 322 of the second sidewall 306.

The bottom wall 308 has a left end 376, a right end 378, a front end 380, and a rear end 382 (shown in FIG. 12). The bottom wall 308 also includes a first panel 384 extending between the left end 376 and the right end 378 and a second panel 386 superimposed on the first panel 384 and extending between the left end 376 and the right end 378. The first panel 384 and the second panel 386 cooperate to define the sheet receiving space 324. The fourth sheet is positioned in the sheet receiving space 324 of the bottom wall 308.

The first sidewall 302, the top wall 204, second sidewall 306, and the bottom wall 308 may be formed of the substantially the same size and materials. The first panel and the second panel of the first, top, second, and bottom walls may be formed of a variety of sizes and materials. The first panel and the second panel of each of the first, top, second, and bottom walls 302/304/306/308 may have, but are not limited to having, a length between about 15.0 and about 30.0 inches. For example, but not by way of limitation, in one embodiment the first panel and the second panel of each of the walls 302/304/306/308 are about 22.75 inches long. When the second panel of each of the walls is superimposed on the first panel of each of the walls 302/304/306/308 may have a variety of thickness and may be, but is not limited to being, between about 0.15 and about 2.0 inches think. For example, but not by way of limitation, in one embodiment, each of the walls 302/304/306/308 is about 0.25 inches thick. The first panel and the second panel of each of the walls 302/304/306/308 may be formed from a variety of materials including, but not limited to acrylic.

The first connecting member 310 is connected to the top end 330 of the first sidewall 302 and the left end 346 of the top wall 304 to connect the first sidewall 302 to the top wall 304. The first connecting member 310 may include a first clip portion 390 connected to the top end 330 of the first sidewall 302 to connect the first panel 338 to the second panel 340 of the first sidewall 302 and a second clip portion 392 connected to the left end 346 of the top wall 304 to connect the first panel 354 to the second panel 356 of the top wall 304. The first connecting member 310 may be constructed substantially similar to the connecting member 140 shown and described with reference to FIG. 8

The second connecting member 312 is connected to the right end 348 of the top wall 304 and to the top end 360 of the second sidewall 306 to connect to the top wall 304 to the second sidewall 306. The second connecting member 312 may include a first clip portion 396 connected to the right end 348 of the top wall 304 to connect the first panel 354 to the second panel 356 of the top wall 304 and a second clip portion 398 connected to the top end 360 of the second sidewall 306 to connect the first panel 368 to the second panel 370 of the second sidewall 306. The second connecting member 312 may be constructed substantially similar to the connecting member 140 shown and described with reference to FIG. 8

The third connecting member 314 is connected to the bottom end 362 of the second sidewall 306 and the right end 378 of the bottom wall 308 to connect the second sidewall 306 to the bottom wall 308. The third connecting member 314 may include first clip portion 402 connected to the bottom end 362 of the second sidewall 306 to connect the first panel 368 to the second panel 370 of the second sidewall 306 and a second clip portion 404 connected to the right end 378 the bottom wall 308 to connect the first panel 384 to the second panel 386 of the bottom wall 308. The third connecting member 314 may be constructed substantially similar to the connecting member 140 shown and described with reference to FIG. 8.

The fourth connecting member 316 is connected to the bottom end 332 of the first sidewall 302 and the left end 376 of the bottom wall 308 to connect the first sidewall 302 to the bottom wall 308. The fourth connecting member 316 may include first clip portion 408 connected to the bottom end 332 of the first sidewall 302 to connect the first panel 338 to the second panel 340 of the first sidewall 302 and a second clip portion 410 connected to the left end 376 of the bottom wall 308 to connect the first panel 384 to the second panel 386 of the bottom wall 308. The fourth connecting member 316 may be constructed substantially similar to the connecting member 140 shown and described with reference to FIG. 8.

As shown in FIG. 13, the dollhouse assembly 10 may further include a front wall 414. The front wall 414 is connected to the first sidewall 302, the top wall 304, the second sidewall 306, and the bottom wall 308. The front wall 414 includes a top 414 end, a bottom end 418, a left end 420, and a right end 422. The front wall 414 is connected to the first sidewall 302, the top wall 304, the second sidewall 306, and the bottom wall 308 by a fifth connecting member 428, a sixth connecting member 430, a seventh connecting member 432, and an eighth connecting member 434, respectively. The front wall 414 may be formed of any suitable material such as, but not limited to acrylic. For example, but not by way of limitation, the front wall 414 may be formed of a single transparent acrylic panel allowing the user to inside the dollhouse assembly 10. The size and shape of the front wall 414 may substantially correspond to the size and shape formed by the first and second sidewalls 302 and 306, the top wall 304, and the bottom wall 16. For example, but not by way of limitation, the front wall 130 may be square shaped.

The fifth connecting member 428 includes a first clip portion 440 connected to the left end 420 front wall 414 and a second clip portion 442 (not shown) connected to the front end 334 of the first sidewall 302. The sixth connecting member 430 includes a first clip portion 446 (not shown) connected to the top end 416 of the front wall 414 and a second clip portion 448 (not shown) connected to the front end 350 of the top wall 304. The seventh connecting member 432 includes a first clip portion 452 connected to the right end 422 of the front wall 414 and a second clip portion 460 (not shown) connected to the front end 364 of the second sidewall 306. The eighth connecting member 434 is includes a first clip portion 458 connected to the bottom end 418 of the front wall 414 and second clip portion 462 (not shown) connected to the front end 380 of the bottom wall 308.

The dollhouse assembly 10 may further include a ninth connecting member 464 for connecting the front wall 414 to the bottom wall 308. The ninth connecting member 464 includes a first clip portion 466 (not shown) connected to the front wall 414 and a second clip portion 468 (not shown) connected to the front end 380 of the bottom wall 308. When the dollhouse assembly 300 includes the ninth connecting member 464, the eighth connecting member 434 is positioned near the first sidewall 302 and the ninth connecting member 464 is positioned near the second sidewall 306. The fifth, sixth, seventh, eighth, and ninth connecting members by constructed substantially the same as the connecting member 140 shown and described in FIG. 8.

Figure 14:
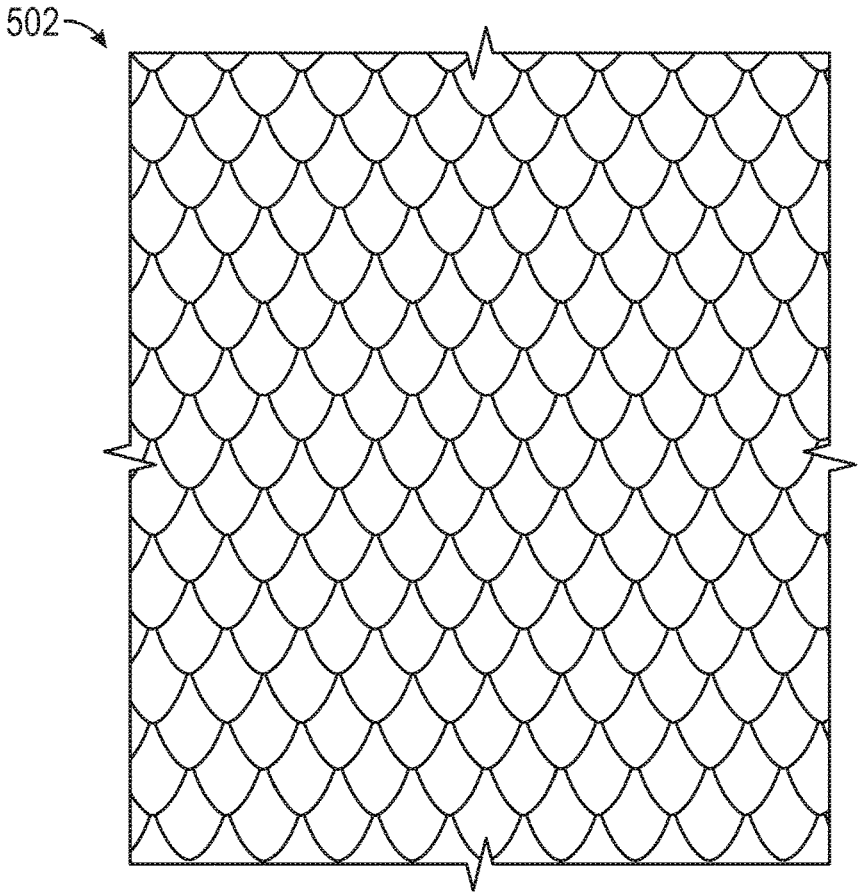
FIG. 14 is a front elevation view of a design for a wall of a dollhouse assembly.
Figure 15:
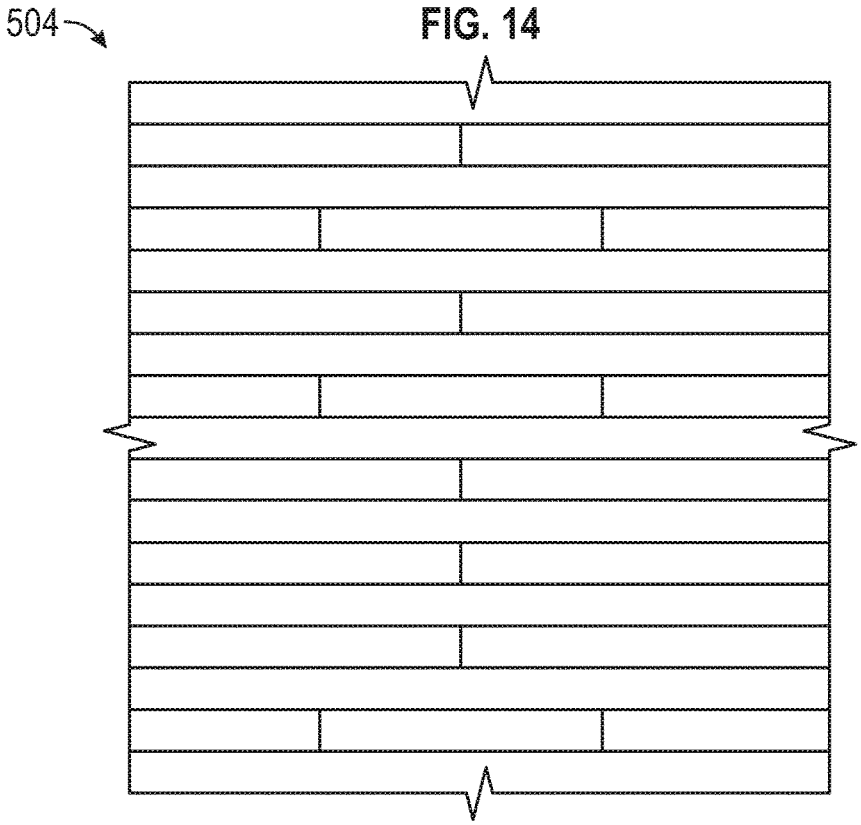
FIG. 15 is a front elevation view of a design for a wall of a dollhouse assembly.
Figure 16:
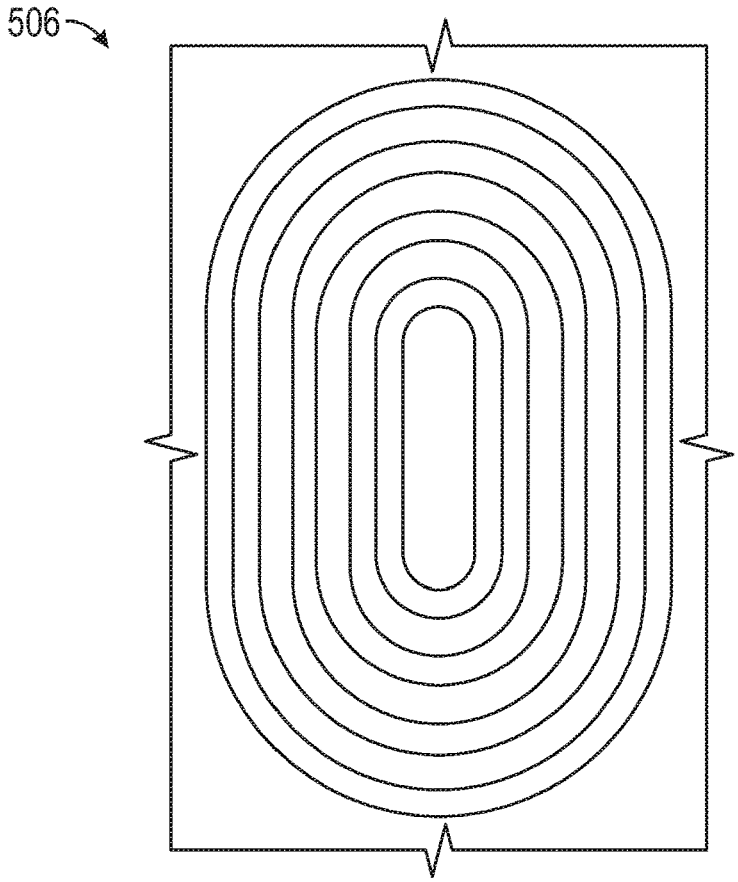
FIG. 16 is a front elevation view of a design for a wall of a dollhouse assembly.
Figure 17:
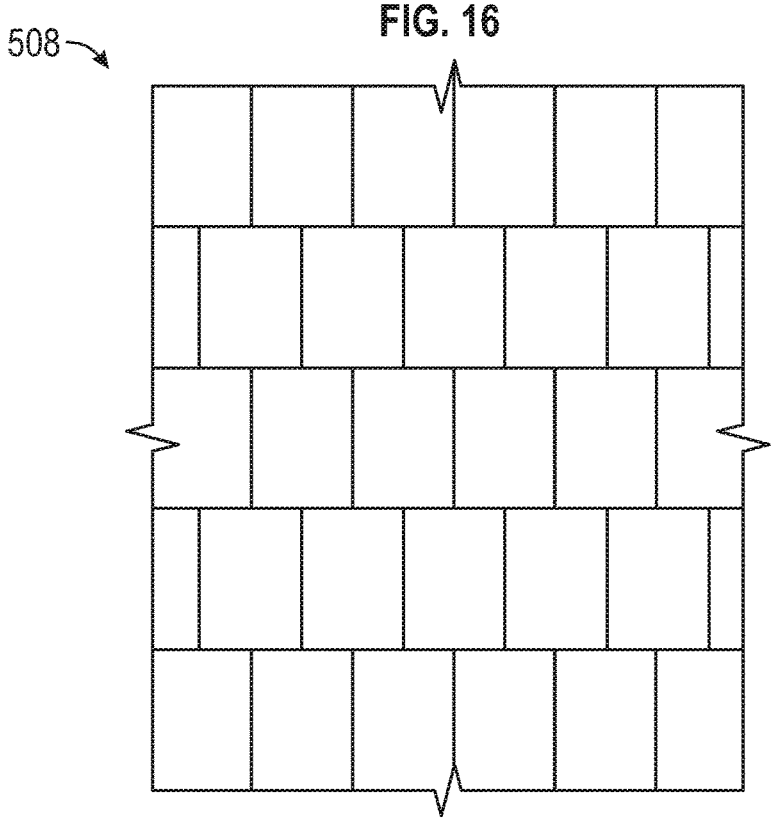
FIG. 17 is a front elevation view of a design for a wall of a dollhouse assembly.
Figure 18:
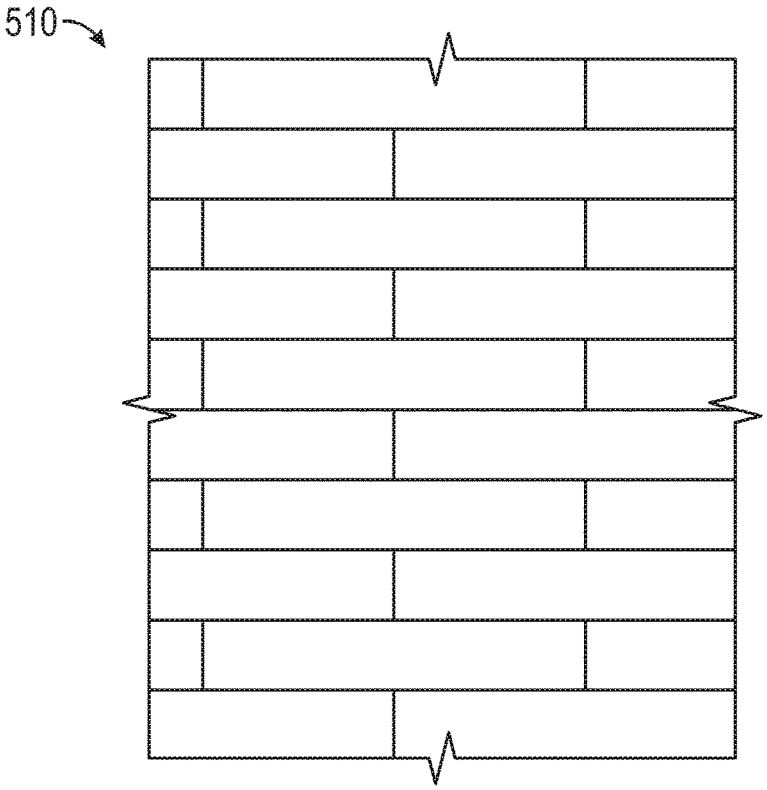
FIG. 18 is a front elevation view of a design for a wall of a dollhouse assembly.
Figure 19:
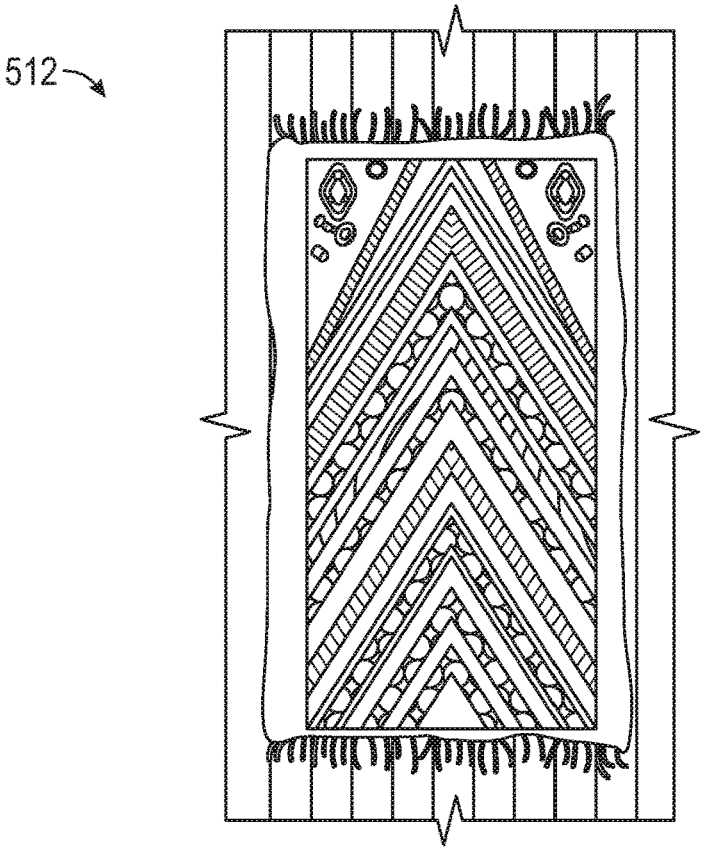
FIG. 19 is a front elevation view of a design for a wall of a dollhouse assembly.
Figure 20:
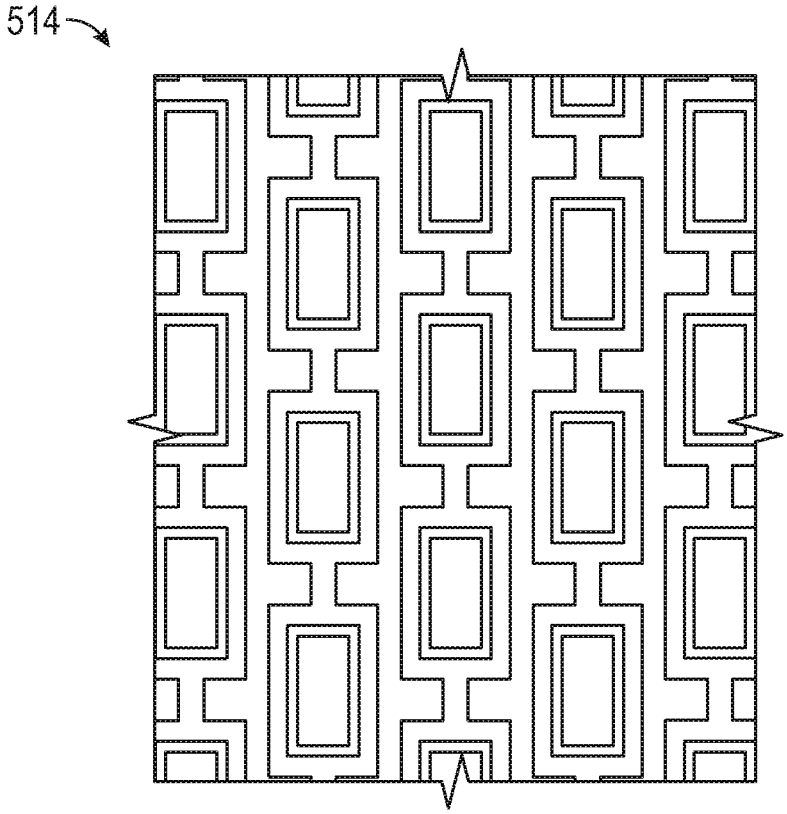
FIG. 20 is a front elevation view of a design for a wall of a dollhouse assembly.
Figure 21:
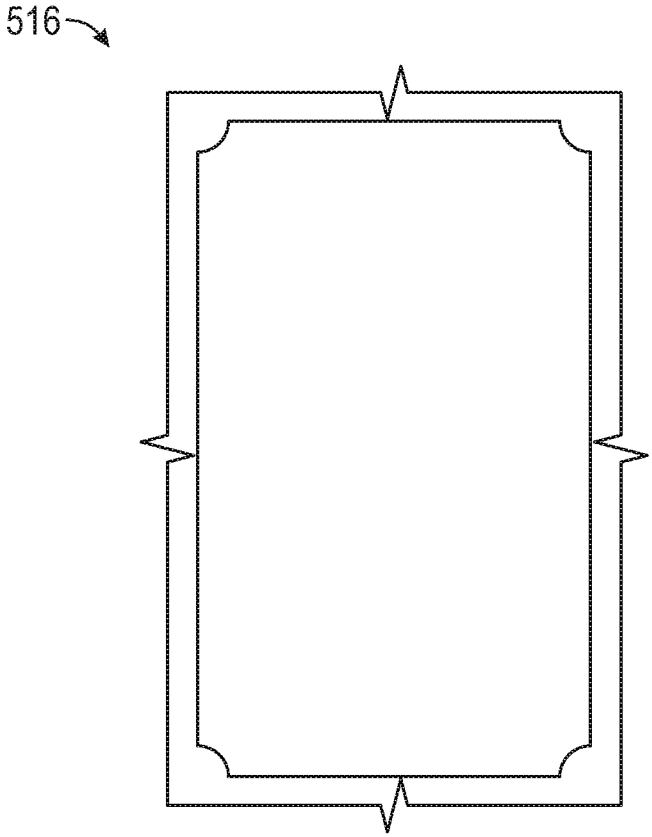
FIG. 21 is a front elevation view of a design for a wall of a dollhouse assembly.
Figure 22:
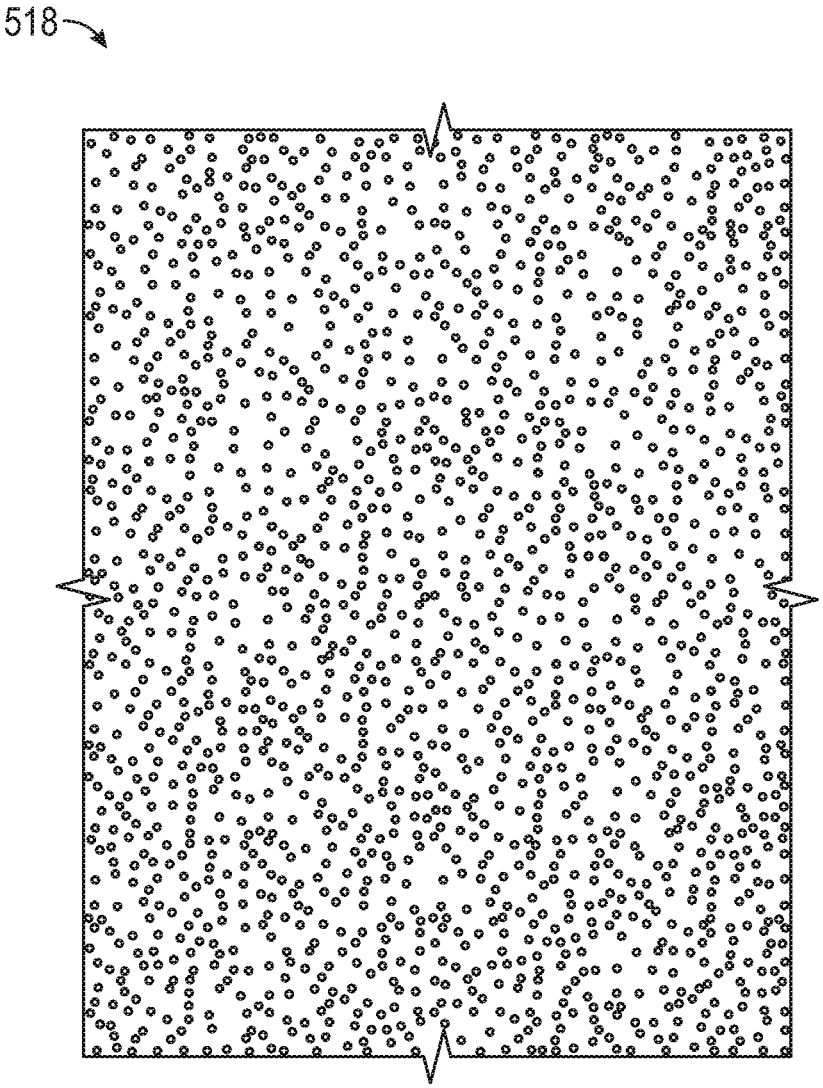
FIG. 22 is a front elevation view of a design for a wall of a dollhouse assembly.

As shown in FIG. 14, the dollhouse assembly 500 may include a door 472. The front wall 414 may form a door opening 474. The door 472 is hingedly connected to the front wall 414 to extend across the door opening 474. Similar to door 200, the door 472 may include a first panel connected to a second panel to form a sheet receiving space. A door sheet may be positioned in the sheet receiving space of the door 472. The second panel of the door 472 may include a top end and a notch 214 positioned at the top end for inserting and removing the door sheet. The door 472 may be formed of a transparent material, and the sheet may include a design for displaying through the door 472. The door sheet may include a design on each side of the sheet. The door sheet may be formed of any suitable material including, but not limited to paper, and may be formed of any suitable size and shape which substantially corresponds to the size and shape of the door 472 and the door sheet receiving space 474. The door 472 may be connected to the front wall 414 by a pair of hinges 510 and 512. The door may also include a handle 514 for opening and closing the door 472. The pair hinges 510/512 and the handle 514 may be formed of any known suitable material including but not limited to the same material as the door 472, which may be, for example, acrylic.

The dollhouse assembly 300 may also include a second door 530 hingedly connected to the front wall 414 to extend across the door opening 472. The second door may 530 also include a first panel connected to a second panel to form a door sheet receiving space. A second door sheet may be positioned in the door sheet receiving space of the second door. The second panel of the second door may include a top end and a notch positioned at the top end for inserting and removing the second door sheet. The second door sheet may include a design on one or more sides of the sheet. The second door 530 may be formed of the substantially the same size and material as the first door.

From the above description, the inventive concepts disclosed are well adapted to carry out the objects and to attain the advantages mentioned and those inherent in the inventive concepts disclosed. While exemplary embodiments of the inventive concepts disclosed have been described for this disclosure, it will be understood that numerous changes may be made which will readily suggest themselves to those skilled in the art and which are accomplished within the scope and coverage of the inventive concepts disclosed.

What is claimed is:

1. A dollhouse assembly, comprising:

a first sidewall having a top end, a bottom end, a front end, and a rear end, the first sidewall including a first panel extending between the top end and the bottom end, and a second panel superimposed on the first panel and extending between the top end and the bottom end, the first panel and the second panel cooperating to a define a sheet receiving space;

a second sidewall having a top end, a bottom end, a front end, and a rear end, the second sidewall including a first panel extending between the top end the bottom end, and a second panel superimposed on the first panel and extending between the top end and the bottom end, the first panel and the second panel cooperating to define a sheet receiving space, the top end of the second sidewall connected to the top end of the first sidewall; and a bottom wall having a left end, a right end, a front end, and a rear end, the bottom wall including a first panel extending between the left end and the right end, and a second panel superimposed on the first panel and extending between the left end and the right end, the first panel and the second panel cooperating to define a sheet receiving space, the right end of the bottom wall connected to the bottom end of the second sidewall and the left end of the bottom wall connected to the bottom end of the first sidewall; and a first sheet insertable in the sheet receiving space of at least one of the first sidewall, the second sidewall, and the bottom wall, wherein the first panel and the second panel of each of the first sidewall, the second sidewall, and the bottom wall are transparent for displaying the first sheet when the first sheet is inserted into the sheet receiving space of at least one of the first sidewall, the second sidewall, and the bottom wall.

2. The dollhouse assembly of claim 1, comprising:

a first connecting member connected to the top end of the first sidewall and the top end of the second sidewall to connect the first sidewall to the second sidewall, the first connecting member including a first clip portion connected to the top end of the first sidewall to connect the first panel of the first sidewall to the second panel of the first sidewall and a second clip portion connected to the top end of the second sidewall to connect the first panel of the second sidewall to the second panel of the second sidewall;

a second connecting member connected to the bottom end of the second sidewall and to the right end of the bottom wall to connect to the second sidewall to the bottom wall, the first connecting member having a first clip portion connected to the bottom end of the second sidewall to connect the first panel of the second sidewall to the second panel of the second sidewall and a second clip portion connected to the right end of the bottom wall to connect the first panel of the bottom wall to the second panel of the bottom wall; and a third connecting member connected to the bottom end of the first sidewall and the left end of the bottom wall to connect the first sidewall to the bottom wall, the third connecting member having a first clip portion connected to the bottom end of the first sidewall to connect the first panel of the first sidewall to the second panel of the first sidewall and a second clip portion connected to the left end of the bottom wall to connect the first panel of the bottom wall to the second panel of the bottom wall.

3. The dollhouse assembly of claim 2, further comprising:

a front wall;

a fourth connecting member having a first clip portion connected to the front wall and a second clip portion connected to the front end of the first sidewall to connect the front wall to the first sidewall;

a fifth connecting member having a first clip portion connected to the front wall and a second clip portion connected to the front end of the second sidewall to connect the front wall to the second sidewall; and a sixth connecting member having a first clip portion connected to the front wall and a second clip portion connected to the front end of the bottom wall to connect the front wall to the bottom wall.

4. The dollhouse assembly of claim 1, further comprising:

a second sheet insertable in the sheet receiving space of at least one of the first sidewall, the second sidewall, and the bottom wall; and a third sheet insertable in the sheet receiving space of at least one of the first sidewall, the second sidewall, and the bottom wall.

5. The dollhouse assembly of claim 4, wherein the first sheet, the second sheet, and the third sheet include a design for displaying between the first panel and the second panel of each of the first sidewall, the second sidewall, and the bottom wall.

6. The dollhouse assembly of claim 1, further comprising:

a front wall connected to the front end of the first sidewall, the front end of the second sidewall, and the front of the bottom wall.

7. The dollhouse assembly of claim 1, further comprising:

a top wall having a left end, a right end, a front end, and a rear end, the top wall including a first panel extending between the left end and the right end, and a second panel superimposed on the first panel and extending between the left end and the right end, the first panel and the second panel cooperating to define a sheet receiving space, the top wall connected to the top end of the first sidewall and the top end of the second sidewall.

8. The dollhouse assembly of claim 7, further comprising:

a first connecting member connected to the top end of the first sidewall and to the left end of the top wall to connect the first sidewall to the top wall, the first connecting member including a first clip portion connected to the top end of the first sidewall to connect the first panel to the second panel of the first sidewall and a second clip portion connected to the left end of the top wall to connect the first panel to the second panel of the top wall;

a second connecting member connected to the left end of the top wall and to the top end of the second sidewall to connect the top wall to the second sidewall, the second connecting member including a first clip portion connected to the left end of the top wall to connect the first panel to the second panel of the top wall, and a second clip portion connected to the top end of the second sidewall to connect the first panel to the second panel of the top wall;

a third connecting member connected to the bottom end of the second sidewall and to the right end of the bottom wall to connect the second sidewall to the bottom wall, the third connecting member having a first clip portion connected to the bottom end of the second sidewall to connect the first panel to the second panel of the second sidewall, and a second clip portion connected to the right end of the bottom wall to connect the first panel to the second panel of the bottom wall; and a fourth connecting member connected to the left end of the bottom wall and to the bottom end of the first sidewall to connect the bottom wall to the first sidewall, the fourth connecting member including a first clip portion connected to the left end of the bottom wall to connect the first panel to the second panel of the bottom wall, and a second clip portion connected to the bottom end of the first sidewall to connect the first panel to the second panel of the first sidewall.

9. The dollhouse assembly of claim 7, further comprising:

a first sheet positioned in the sheet receiving space of the first sidewall;

a second sheet positioned in the sheet receiving space of the second sidewall;

a third sheet positioned in the sheet receiving space of the bottom wall; and a fourth sheet positioned in the sheet receiving space of the top wall.

10. The dollhouse assembly of claim 9, wherein the first panel and the second panel of each of the first sidewall, the second sidewall, the bottom wall, and the top wall are transparent and first sheet, the second sheet, the third sheet, and the fourth sheet include a design for displaying between first panel and the second panel of each of the first sidewall, the second sidewall, the bottom wall, and the top wall.

11. The dollhouse assembly of claim 7, furthering comprising:

a front wall having a top end, a bottom end, a left end, and right end, the left end of the front wall connected to the front end of the first sidewall, the top end of the front wall connected to the front end of the first sidewall, the right end of the top wall connected to the front end of the second sidewall, and the bottom end of the front wall connected to the front end of the bottom wall.

12. The dollhouse assembly of claim 7, furthering comprising:

a front wall having a top end, a bottom end, a left end, and right end;

a fifth connecting member having a first clip portion connected to the left end of the front wall and a second clip portion connected to the front end of the first sidewall to connect the front wall to the first sidewall;

a sixth connecting member having a first clip portion connected to the top end of the front wall and a second clip portion connected to the front end of the top wall to connect the front wall to the top wall;

a seventh connecting member having a first clip portion connected to the right end of the front wall and a second clip portion connected to the front end of the second sidewall to connect the front wall to the second sidewall; and an eighth connecting member having a first clip portion connected to the bottom end of the front wall and a second clip portion connected to the front end of the bottom wall to connect the front wall to the bottom wall.

13. A kit for forming dollhouse assembly, comprising:

a first sidewall having a top end, a bottom end, a front end, and a rear end, the first sidewall including a first panel extending between the top end and the bottom end, and a second panel superimposable on the first panel and extending between the top end and the bottom end, the first panel and the second panel cooperating to a define a sheet receiving space;

a second sidewall having a top end, a bottom end, a front end, and a rear end, the second sidewall including a first panel extending between the top end the bottom end, and a second panel superimposable on the first panel and extending between the top end and the bottom end, the first panel and the second panel cooperating to define a sheet receiving space, the top end of the second sidewall connectable to the top end of the first sidewall;

a bottom wall having a left end, a right end, a front end, and a rear end, the bottom wall including a first panel extending between the left end and the right end, and a second panel superimposable on the first panel and extending between the left end and the right end, the first panel and the second panel cooperating to define a sheet receiving space, the right end of the bottom wall connectable to the bottom end of the second sidewall, and the left end of the bottom wall connectable to the bottom end of the first sidewall; and a first sheet insertable in the sheet receiving space of at least one of the first sidewall, the second sidewall, and the bottom wall, wherein the first panel and the second panel of each of the first sidewall, the second sidewall, and the bottom wall are transparent.

14. The kit of claim 13, further comprising:

a first connecting member connectable to the top end of the first sidewall and the top end of the second sidewall to connect the first sidewall to the second sidewall, the first connecting member including a first clip portion connectable to the top end of the first sidewall to connect the first panel of the first sidewall to the second panel of the first sidewall and a second clip portion connectable to the top end of the second sidewall to connect the first panel of the second sidewall to the second panel of the second sidewall;

a second connecting member connectable to the bottom end of the second sidewall and to the right end of the bottom wall to connect to the second sidewall to the bottom wall, the first connecting member having a first clip portion connectable to the bottom end of the second sidewall to connect the first panel of the second sidewall to the second panel of the second sidewall and a second clip portion connectable to the right end of the bottom wall to connect the first panel of the bottom wall to the second panel of the bottom wall; and a third connecting member connectable to the bottom end of the first sidewall and the left end of the bottom wall to connect the first sidewall to the bottom wall, the third connecting member having a first clip portion connectable to the bottom end of the first sidewall to connect the first panel of the first sidewall to the second panel of the first sidewall and a second clip portion connectable to the left end of the bottom wall to connect the first panel of the bottom wall to the second panel of the bottom wall.

15. The kit of claim 14, further comprising:

a front wall;

a fourth connecting member having a first clip portion connectable to the front wall and a second clip portion connectable to the front end of the first sidewall to connect the front wall to the first sidewall;

a fifth connecting member having a first clip portion connectable to the front wall and a second clip portion connectable to the front end of the second sidewall to connect the front wall to the second sidewall; and a sixth connecting member having a first clip portion connectable to the front wall and a second clip portion connectable to the front end of the bottom wall to connect the front wall to the bottom wall.

16. The kit of claim 13, further comprising:

a second sheet insertable in the sheet receiving space of at least one of the first sidewall, the second sidewall, and the bottom wall; and a third sheet positionable in the sheet receiving space of at least one of the first sidewall, the second sidewall, and the bottom wall.

17. The kit of claim 16, wherein the first sheet, the second sheet, and the third sheet include a design for displaying between the first panel and the second panel of each of the first sidewall, the second sidewall, and the bottom wall.

18. The kit of claim 13, further comprising:

a front wall connectable to the front end of the first sidewall, the front end of the second sidewall, and the front of the bottom wall.

19. The kit of claim 13, further comprising:

a top wall having a left end, a right end, a front end, and a rear end, the top wall including a first panel extending between the left end and the right end, and a second panel superimposable on the first panel and extending between the left end and the right end, the first panel and the second panel cooperating to define a sheet receiving space, the top wall connectable to the top end of the first sidewall and the top end of the second sidewall.

20. The kit of claim 19, further comprising:

a first connecting member connectable to the top end of the first sidewall and to the left end of the top wall to connect the first sidewall to the top wall, the first connecting member including a first clip portion connectable to the top end of the first sidewall to connect the first panel to the second panel of the first sidewall and a second clip portion connectable to the left end of the top wall to connect the first panel to the second panel of the top wall;

a second connecting member connectable to the left end of the top wall and to the top end of the second sidewall to connect the top wall to the second sidewall, the second connecting member including a first clip portion connected to the left end of the top wall to connect the first panel to the second panel of the top wall, and a second clip portion connected to the top end of the second sidewall to connect the first panel to the second panel of the top wall;

a third connecting member connectable to the bottom end of the second sidewall and to the right end of the bottom wall to connect the second sidewall to the bottom wall, the third connecting member having a first clip portion connected to the bottom end of the second sidewall to connect the first panel to the second panel of the second sidewall, and a second clip portion connected to the right end of the bottom wall to connect the first panel to the second panel of the bottom wall; and a fourth connecting member connectable to the left end of the bottom wall and to the bottom end of the first sidewall to connect the bottom wall to the first sidewall, the fourth connecting member including a first clip portion connected to the left end of the bottom wall to connect the first panel to the second panel of the bottom wall, and a second clip portion connected to the bottom end of the first sidewall to connect the first panel to the second panel of the first sidewall.

21. The kit of claim 20, furthering comprising:

a front wall having a top end, a bottom end, a left end, and a right end, the left end of the front wall connectable to the front end of the first sidewall, the top end of the front wall connectable to the front end of the first sidewall, the right end of the top wall connectable to the front end of the second sidewall, and the bottom end of the front wall connectable to the front end of the bottom wall;

a fifth connecting member having a first clip portion connectable to the left end of the front wall and a second clip portion connectable to the front end of the first sidewall to connect the front wall to the first sidewall;

a sixth connecting member having a first clip portion connectable to the top end of the front wall and a second clip portion connectable to the front end of the top wall to connect the front wall to the top wall;

a seventh connecting member having a first clip portion connectable to the right end of the front wall and a second clip portion connectable to the front end of the second sidewall to connect the front wall to the second sidewall; and an eighth connecting member having a first clip portion connectable to the bottom end of the front wall and a second clip portion connectable to the front end of the bottom wall to connect the front wall to the bottom wall.

22. The kit of claim 19, further comprising:

a first sheet positionable in the sheet receiving space of the first sidewall;

a second sheet positionable in the sheet receiving space of the second sidewall;

a third sheet positionable in the sheet receiving space of the bottom wall; and a fourth sheet positionable in the sheet receiving space of the top wall.

23. The kit of claim 19, wherein the first panel and the second panel of each of the first sidewall, the second sidewall, the bottom wall, and the top wall are transparent and first sheet, the second sheet, the third sheet, and the fourth sheet include a design for displaying between first panel and the second panel of each of the first sidewall, the second sidewall, the bottom wall, and the top wall.

24. The kit of 19, furthering comprising:

a front wall having a top end, a bottom end, a left end, and right end, the left end of the front wall connectable to the front end of the first sidewall, the top end of the front wall connectable to the front end of the first sidewall, the right end of the top wall connectable to the front end of the second sidewall, and the bottom end of the front wall connectable to the front end of the bottom wall.

* * * * *